US011850698B2

(12) United States Patent
Fowler et al.

(10) Patent No.: US 11,850,698 B2
(45) Date of Patent: Dec. 26, 2023

(54) AUTOMATIC KNIFE SHARPENING MACHINE WITH SHARPNESS DETECTION

(71) Applicant: THE HILLMAN GROUP, INC., Cincinnati, OH (US)

(72) Inventors: Whitfield Janes Fowler, Santa Clara, CA (US); Sean Stone, Santa Clara, CA (US); Ari Bennett, San Francisco, CA (US); Jeffrey Kastenbaum, Mamaroneck, NY (US); David Frederick Lyons, Palo Alto, CA (US); Dmitriy Kolchin, San Francisco, CA (US)

(73) Assignee: The Hillman Group, Inc., Forest Park, OH (US)

( * ) Notice: Subject to any disclaimer, the term of this patent is extended or adjusted under 35 U.S.C. 154(b) by 604 days.

(21) Appl. No.: 16/775,551

(22) Filed: Jan. 29, 2020

(65) Prior Publication Data

US 2020/0246933 A1 Aug. 6, 2020

Related U.S. Application Data

(60) Provisional application No. 62/824,818, filed on Mar. 27, 2019, provisional application No. 62/799,694, filed on Jan. 31, 2019.

(51) Int. Cl.
*B24B 3/54* (2006.01)
*B24B 49/12* (2006.01)

(52) U.S. Cl.
CPC ..... *B24B 3/54* (2013.01); *B24B 49/12* (2013.01)

(58) Field of Classification Search
CPC .... B24B 3/54; B24B 3/36; B24B 3/52; B24B 3/00; B24B 3/546; B24B 3/605;
(Continued)

(56) References Cited

U.S. PATENT DOCUMENTS 1,087,527 A 2/1914 Button
4,722,152 A 2/1988 Ek et al.
(Continued)

FOREIGN PATENT DOCUMENTS

CN 110524322 A * 12/2019 ..... B24B 27/0076
KR 10-2017-0083412 A 7/2017

OTHER PUBLICATIONS

Extended European Search Report, dated Jun. 28, 2021, issued in European Application No. 18874668.9 (11 pages).
(Continued)

*Primary Examiner* — Joel D Crandall
*Assistant Examiner* — Michael A Gump
(74) *Attorney, Agent, or Firm* — Finnegan, Henderson, Farabow, Garrett & Dunner LLP

(57) ABSTRACT

An automatic knife sharpening machine may include a vice to grip a blade of a knife and a pair of grind wheels to grind material from the blade. The machine may include a scanner to determine a profile of an edge of the blade, and a sharpness sensor to determine a sharpness level of the edge. The machine may include a controller. The controller may perform a first sharpening pass on the knife by moving the grind wheels into contact with the blade, and advancing the grind wheels longitudinally along the blade from adjacent the vice towards a tip of the blade with the grind wheels in contact with the blade. The controller may determine, using the sharpness sensor, the sharpness level of the edge after the first sharpening pass and perform at least one second sharpening pass when the determined sharpness level is less than a threshold sharpness level.

20 Claims, 12 Drawing Sheets

(58) Field of Classification Search
CPC ..... B24B 49/12; B24D 15/065; B24D 15/08; B24D 15/081; B24D 15/082; B24D 15/02; B24D 15/063; B24D 15/06; B24D 15/084; B24D 15/085
USPC ..... 451/6, 45, 371, 372, 552, 555
See application file for complete search history.

(56) References Cited

U.S. PATENT DOCUMENTS

| | | | | |
|---|---|---|---|---|
| 5,196,800 | A * | 3/1993 | Graff | B24B 49/10 73/104 |
| 5,390,445 | A | 2/1995 | Giovanazzi et al. | |
| 5,793,493 | A * | 8/1998 | Lane | G01B 11/24 356/613 |
| 5,906,534 | A | 5/1999 | Folkman et al. | |
| 8,915,766 | B1 * | 12/2014 | Kolchin | B24B 49/12 451/5 |
| 10,272,535 | B1 | 4/2019 | Lyons et al. | |
| 2004/0198181 | A1 | 10/2004 | Tajima et al. | |
| 2011/0281503 | A1 | 11/2011 | Knecht et al. | |
| 2012/0156964 | A1 | 6/2012 | Anderson | |
| 2014/0273749 | A1 * | 9/2014 | Qian | B24B 35/005 451/5 |
| 2017/0087690 | A1 * | 3/2017 | Vogel | B24B 3/54 |
| 2018/0028898 | A1 * | 2/2018 | Chan | B24B 3/003 |
| 2018/0236623 | A1 * | 8/2018 | Robinson | B24B 53/003 |
| 2019/0084113 | A1 * | 3/2019 | Dovel | B24B 49/12 |
| 2019/0126423 | A1 * | 5/2019 | Lyons | B24B 49/02 |
| 2019/0210177 | A1 * | 7/2019 | Graves | B24B 55/02 |
| 2020/0361049 | A1 * | 11/2020 | Tsukanov | B24B 51/00 |

OTHER PUBLICATIONS

PCT International Search Report and Written Opinion, dated Apr. 28, 2020, issued in corresponding PCT Application No. PCT/US20/15584 (10 pages).

Office Action, dated Aug. 26, 2021, issued in Chinese Patent Application No. 201880084787.0 (20 pages including translation).

Extended European Search Report, dated Sep. 23, 2022, issued in European Application No. 20749184.6 (7 pages).

* cited by examiner

AUTOMATIC KNIFE SHARPENING MACHINE WITH SHARPNESS DETECTION

CROSS-REFERENCE TO RELATED APPLICATION

This application is based on and claims benefit of priority of U.S. Provisional Patent Application No. 62/799,694, filed Jan. 31, 2019, and U.S. Provisional Patent Application No. 62/824,818, filed Mar. 27, 2019, the contents of both of which are incorporated herein by reference in their entireties.

TECHNICAL FIELD

The present disclosure relates generally to an automatic knife sharpening machine and more particularly to an automatic knife sharpening machine having sharpness detection capabilities.

BACKGROUND

Most knives, whether they are kitchen knives, dining knives, utility knives, or knives for combat, become dull over time. Regular use, incorrect handling or storage, and wear and tear due to environmental factors all contribute to degradation of the sharpness of a knife. The process of re-sharpening a knife to its original performance and specification requires skill. A higher quality re-sharpening may be obtained at a hardware store or by engaging the services of skilled knife smith. But these approaches are labor and time intensive transactions and may also be expensive. Therefore, there exists a need to provide easy to use, low cost, and efficient tools and methods to allow everyday users to re-sharpen their knives.

A very high variability may be expected in the knives that need sharpening. For example, there may be a large variety of knives of different styles and shapes, which may be used for various purposes. The level of sharpness of a knife that requires sharpening may depend on how it is used, duration of use, and how the knife is stored, Thus, there may be significant variability in the initial level of sharpness of the knives that require sharpening. Therefore, there is a need to provide tools for re-sharpening knives that can detect the level of sharpness of a knife and provide a knife sharpening regimen customized based on an initial condition of the knife.

The automatic knife sharpening machine of the present disclosure solves one or more of the problems set forth above and/or other problems of the prior art.

SUMMARY

In one aspect, an automatic knife sharpening machine is disclosed. The machine may have a vice configured to grip a blade of a knife. The machine may also have a pair of grind wheels configured to grind material from the blade. Further, the machine may have a scanner configured to determine a profile of an edge of the blade. The machine may also have a sharpness sensor configured to determine a sharpness level of the edge. The machine may have a controller. The controller may perform a first sharpening pass on the knife by moving the grind wheels into contact with the blade, and advancing the grind wheels longitudinally along the blade from adjacent the vice towards a tip of the blade with the grind wheels in contact with the blade. The controller may determine, using the sharpness sensor, the sharpness level of the edge after the first sharpening pass. And, when the determined sharpness level is less than a threshold sharpness level, the controller may perform at least one second sharpening pass on the knife.

In another aspect, a method of automatically sharpening a knife is disclosed. The method may include clamping a blade of a knife in a vice. The method may also include scanning the blade using a scanner. Further, the method may include determining, using a controller, an initial blade profile based on signals received from the scanner. The method may include performing a first sharpening pass on the knife by engaging a pair of grind wheels disposed on either side of the blade with the blade, and advancing the grind wheels along a longitudinal direction of the blade from adjacent the vice to adjacent a tip of the blade with the grind wheels in contact with the blade. The method may also include determining, using a sharpness sensor, a sharpness level of an edge of the blade after performing the first sharpening pass. And, when the determined sharpness level is less than a threshold sharpness level, the method may include performing at least one second sharpening pass on the knife.

DETAILED DESCRIPTION

Figure 1:
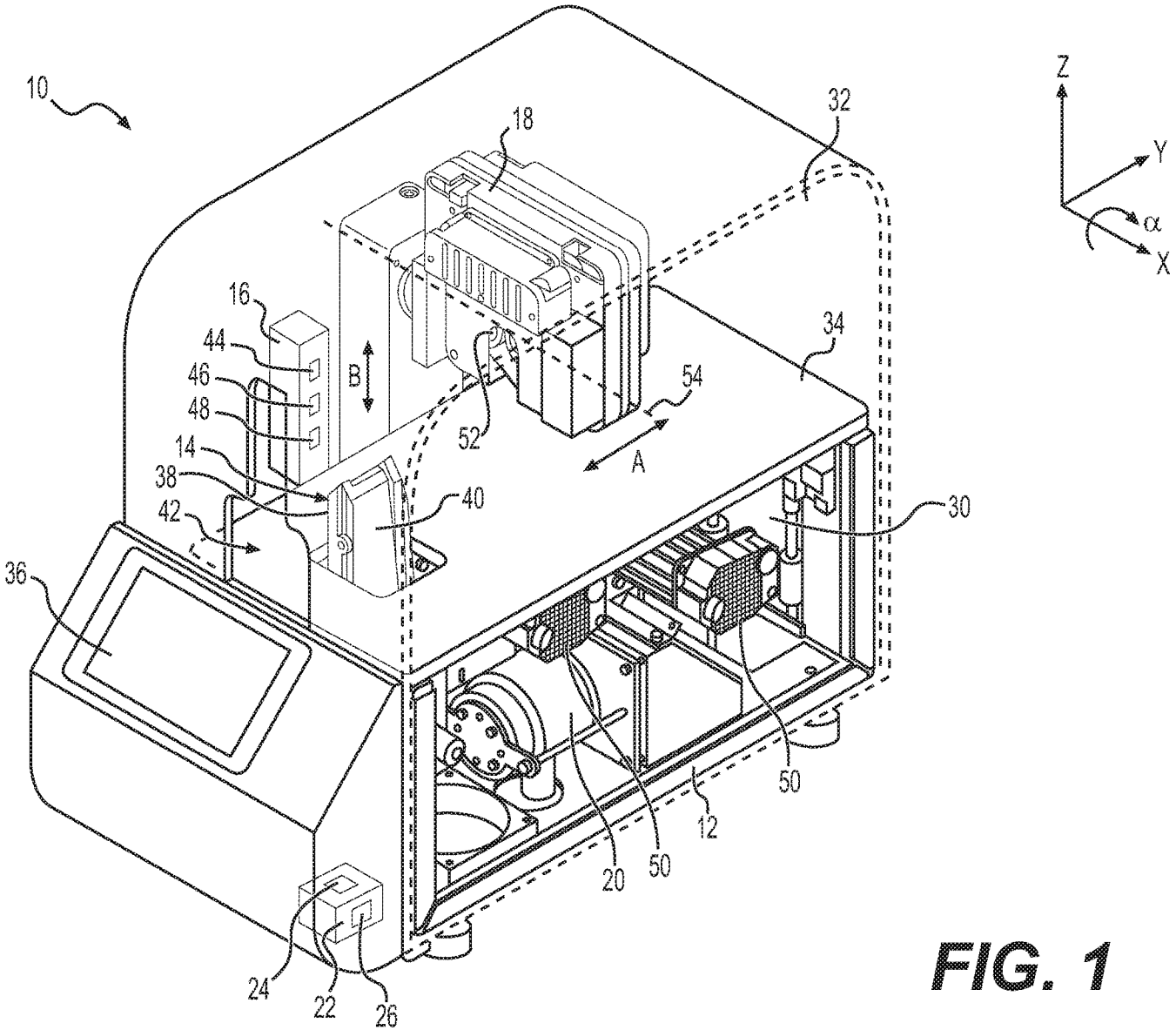
FIG. 1 illustrates of an exemplary embodiment of an automatic knife-sharpening machine.

FIG. 1 illustrates an exemplary automatic knife sharpening machine 10. Machine 10 may include chassis 12, vice 14, sensor head 16, grind head 18, vacuum unit 20, and controller 22 Chassis 12 may be configured to enclose and support various elements of machine 10. Chassis 12 may include lower enclosure 30 and upper enclosure 32 separated by wall 34. Grind head 18 and portions of vice 14 and sensor head 16 may be disposed in upper enclosure 32. Vacuum unit 20 and various actuators associated with machine 10 may be disposed in lower enclosure 30. Chassis 12 may include display 36 capable of displaying a user interface configured to serve prompts and/or to indicate a state of machine 10 to a user. In one exemplary embodiment, display 36 may include a touchscreen arranged near a front of chassis 12.

Touchscreen 36 may render instructions, prompts, and virtual inputs for a user during a scan cycle and a grind cycle for a knife. Alternatively, display 36 may include a digital or analog display and separate digital or analog input regions. Display 36 may also be equipped with one or more payment devices configured to receive payment from the user.

Vice 14 may be configured to retain a blade of a knife during knife sharpening operations. Vice 14 may include vice jaws 38, 40 and one or more vice actuators (not shown) disposed in lower enclosure 30. The one or more vice actuators may be configured to open or close jaws 38, 40. As also illustrated in FIG. 1, upper enclosure 32 may include knife window (or opening) 42 that may be configured to allow insertion of a knife (not shown) into chassis 12 for retention by vice 14. For example, a user may grasp a handle of a knife, insert the knife point-first through knife window 42, locate a spine of the knife in vice 14 and push the handle fully forward to locate a bolster of the knife in contact with a front of the vice 14. Controller 22 may cause the vice actuator to close jaws 38 and 40, thereby retaining the spine of the knife. The user may then release the knife with the blade of the knife now retained by vice 14.

Sensor head 16 may be disposed adjacent grind head 18 on one side of vice 14. It is contemplated, however, that sensor head 16 may additionally or alternatively include portions disposed on an opposite side of vice 14 along a width direction (perpendicular to direction A) of chassis 12. It is also contemplated that in some exemplary embodiments, sensor head 16 may take the form of an inverted U-shaped member having legs on either side of vice 14 and a cross member disposed above vice 14 and connecting the two legs. Sensor head 16 may include one or more of blade sensor (or scanner) 44, sharpness sensor 46, and/or profile sensor 48. Although sensors 44, 46, and 48 have been illustrated in FIG. 1 as arranged vertically relative to each other, it is contemplated that sensors 44, 46, and 48 may be arranged in any manner respective to each other on sensor head 16. When sensor head 16 includes portions disposed on either side of vice 14, some of sensors 44, 46, and/or 48, may be disposed on one side of vice 14 and some may be disposed on an opposite side of vice 14. It is also contemplated that one or more of sensors 44, 46, and/or 48 may, have one or more components disposed on either side of vice 14. It is further contemplated that sensor head 16 may include one or more additional sensors, for example, proximity sensors, light sensors, contact sensors, etc. In some exemplary embodiments, one or more of sensors 44, 46, and/or 48 may additionally or alternatively be disposed in grind head 18. Lower enclosure 30 of chassis 12 may include one or more actuators 50, which may include, for example, motors, hydraulic or pneumatic actuators, rack and pinion arrangements, gear arrangements, etc. One or more of actuators 50 may be configured to move sensor head 16 from adjacent vice 14 in a longitudinal direction along a length of chassis 12, for example, along direction A. Likewise, one or more of actuators 50 may be configured to move one or more of sensors 44, 46, and/or 48 in a vertical direction generally perpendicular to A (e.g. along direction B)

Grind head 18 may include a pair of grind wheels 52. One or more of actuators 50 may be configured to move grind head 18 relative to vice 14. For example, one or more of actuators 50 may be configured to move grind head 18 along a length of chassis 12 in direction A. Other actuators 50 may be configured to move grind head 18 vertically relative to vice 14, for example, in a direction B. Yet other actuators 50 may be configured to pitch grind head 18 relative to pitch axis 54 disposed generally perpendicular to both the longitudinal and vertical directions A and B, respectively.

Figure 2A:
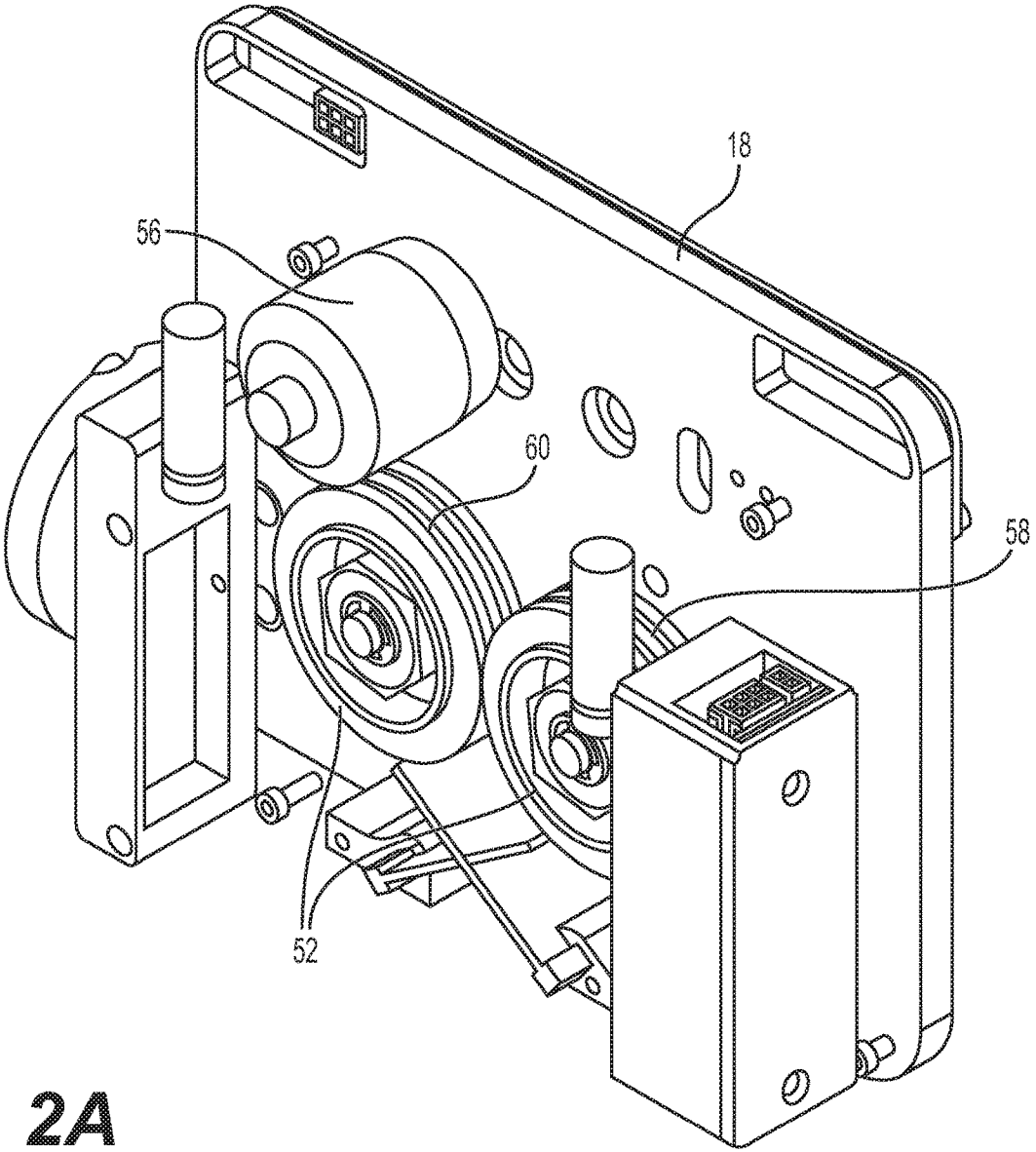
FIGS. 2A and 2B illustrate an exemplary arrangement of grind wheels in the automatic knife-sharpening machine of FIG. 1.
Figure 2B:
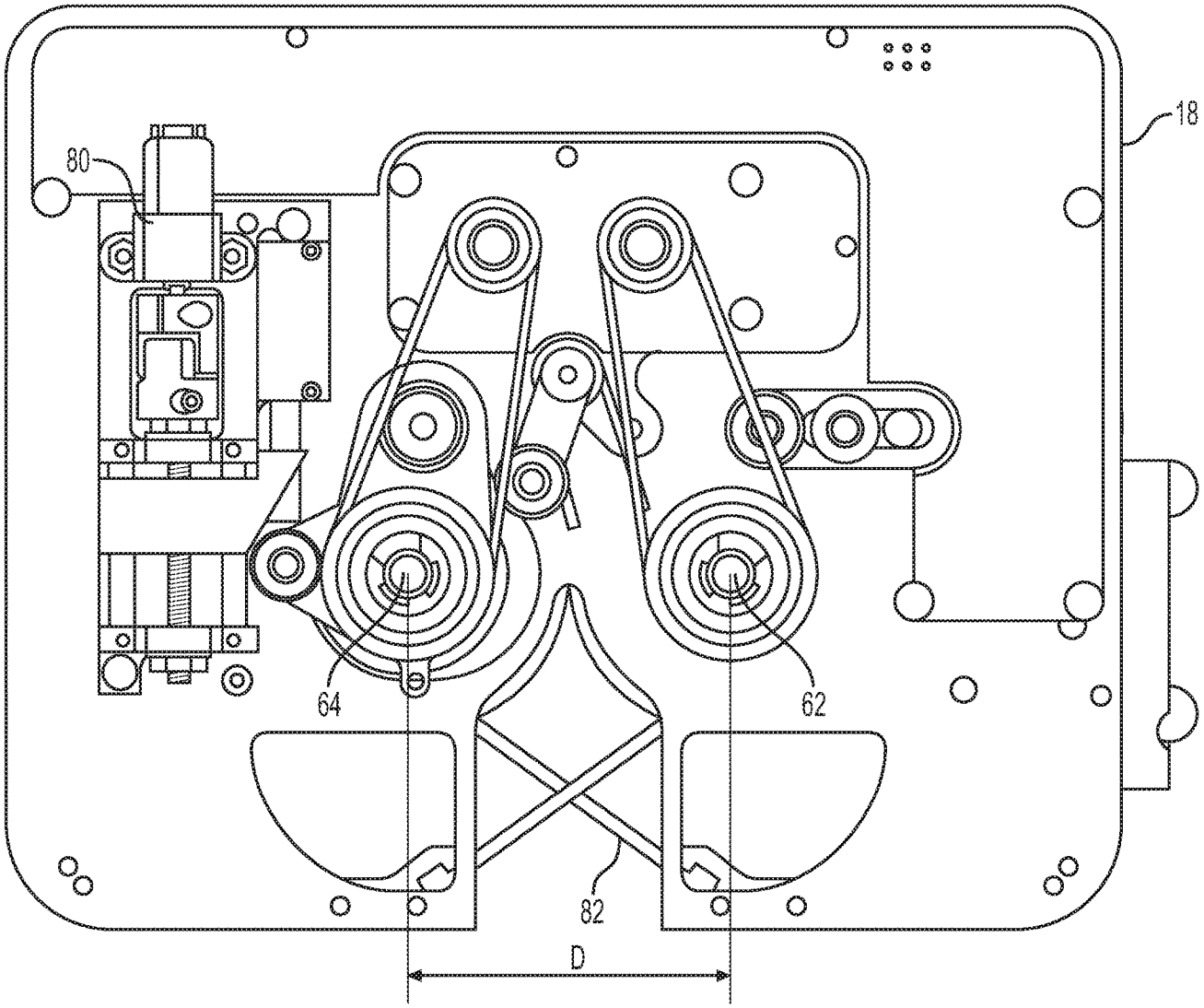

FIGS. 2A and 2B illustrate the arrangement of grind wheels 52 in grind head 18. As illustrated in FIG. 2A, grind head 18 may include grind actuator 56 configured to actuate (e.g. rotate) grind wheels 54. In some exemplary embodiments, grind actuator 56 may include an electrical motor. Each grind wheel 54 may include a helical grind surface with an abrasive coating or abrasive features burrs, serrations). In one exemplary embodiment, each grind wheel 54 may be forged in steel into a (approximately) cylindrical wheel, ground or machined to form a cylindrical or ellipsoidal grind surface profile, and ground or machined to cut a deep helix into the grind surface. The grind surface may also be polished, case hardened, hard-chrome plated, and/or coated with an abrasive (e.g., a diamond-based 80-grit abrasive coating). In one exemplary embodiment, first grind wheel 58 may be ground with a left-hand helix, and second grind wheel 60 may be ground with a left-hand helix.

As further illustrated in FIG. 2B, grind head 18 may include first axle 62 configured to engage and support first grind wheel 58, and second axle 64 configured to engage and support second grind wheel 60. Grind actuator 56 may be coupled to first and second axles 62, 64, for example, via two separate timing belts or via a single serpentine timing belt, such that the first and second axles 62, 64 may counterrotate when grind actuator 56 is active. In one exemplary embodiment as illustrated in FIG. 2B, a centerline distance "D" between the first and second axles 62, 64 in a direction perpendicular to direction A may be less than the major diameter of each grind wheel 58, 60. As a result, helical sections of the first and second grind wheels 58, 60 mounted to first and second axles 62, 64, respectively may interdigitate (or "interleave"), Furthermore, the timing belt(s) may be configured to maintain a phase (or "clocking") between first and second axles 62, 64 to prevent interdigitated faces of first and second grind wheels 58, 60 from crashing against one another when grind actuator 56 rotates grind wheels 58, 60. In one exemplary embodiment in which grind wheels 58, 60 define generally cylindrical grind surfaces, the interdigitated grind wheels 58, 60 may overlap to form a substantially linear apex parallel to, centered between, and offset below the centerlines of first and second axles 62, 64.

Figure 3:
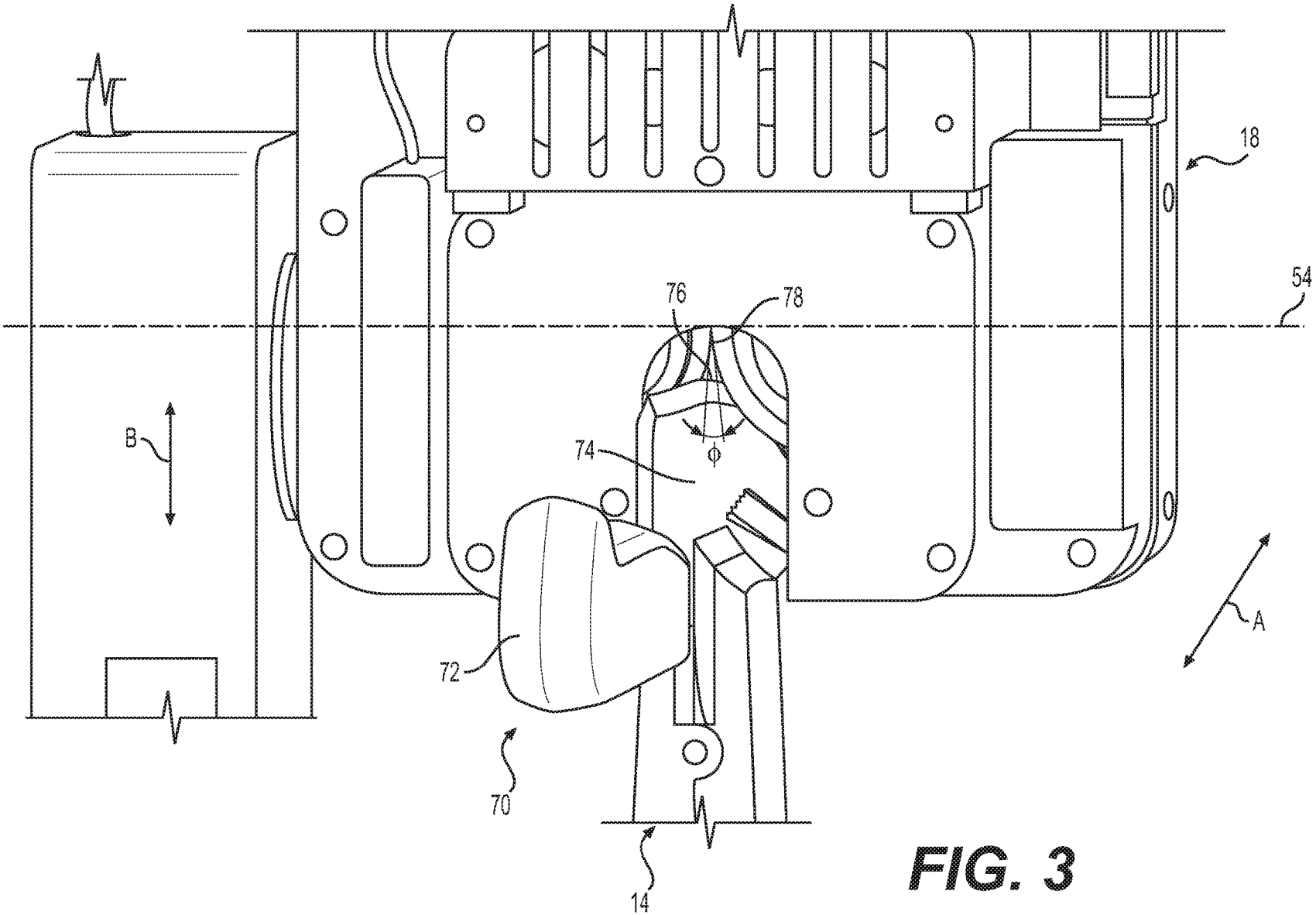
FIG. 3 illustrates a partial view of an exemplary grind head including the grind wheel arrangement of FIGS. 2A and 2B.

FIG. 3 illustrates a partial view of grind head 18, showing knife 70 retained in vice 14. As illustrated in FIG. 3, knife 70 may include handle 72 and blade 74. Vice 14 may grip (or clamp) a portion of blade 74 adjacent handle 72 so that cutting edge 76 of blade 74 is positioned adjacent apex 78 formed by grind wheels 58, 60. As also illustrated in FIG. 3, grind wheels 58, 60 may be positioned to provide an apex angle $\phi$.

Returning to FIG. 2B, grind head 18 may include a centerline adjustment mechanism configured to adjust centerline distance D between first and second axles 62, 64. For example, grind head 18 may include centerline adjustment actuator 80 (see FIG. 2B) configured to separate or bring closer first and second axles 62, 64, thereby modifying an effective apex angle $\phi$. This in turn may affect a bevel angle ground along a blade of a knife by grind wheels 58, 60. For example, by decreasing the centerline distance between the first and second axles 62, 64 may shift grind wheels 58, 60 closer together, decreasing the apex angle $\phi$ formed by grind wheels 58, 60, thus yielding a steeper bevel on a blade. Conversely, by increasing the centerline distance between first and second axles 62, 64 may shift grind wheels 58, 60 further apart, increasing the apex angle formed by grind wheels 58, 60, and yielding a shallow bevel on a blade. As also illustrated in FIG. 2B, in one exemplary embodiment, grind head 18 may include brushes 82 extending toward (or up to) grind wheels 58, 60, and configured to catch particulate ground from edge 76 of blade 74.

Vacuum unit 20 may be fluidly coupled to a vacuum port (not shown) on grind head 18 via a vacuum duct (not shown). Vacuum unit 20 may be configured to draw particulate removed from a blade 74 by grind wheels 58, 60 through the vacuum duct and into a waste container (not shown) located within lower enclosure 30.

FIGS. 2A, 2B, and 3 illustrate a single grind head 18 with a sing pair of grind wheels 58, 60. It is contemplated, however, that grind head 18 may include a plurality of pairs of grind wheels 58, 60, each of the pairs of grind wheels 58, 60 having different grind media (e.g. abrasives of different grit). In this configuration, grind head 18 may include additional actuators (not shown) that may be configured to move the different pairs of grind wheels 58, 60 relative to each other to ensure that only one pair of grind wheels 58, 60 may be able to contact the blade of a knife during knife sharpening operations. Additionally or alternatively, machine 10 may be equipped with a plurality of grind heads 18, each grind head 18 having a pair of grind wheels 58, 60, In this configuration, grind wheels 58, 60 in different grind heads 18 may include different grind media. Moreover machine 10 may include one or more actuators that may allow selection of a grind head 18 from among the plurality of grind heads 18 for use during knife sharpening operations.

Grind media may come in many forms, for example, injection molded wheels permeated with ceramic, unitized non-woven wheels with abrasive in them, abrasive coated steel wheels, resin bonded grinding wheels, belts, or any other grinding media that may be used the grind, sharpen, or hone a knife. Different types of grinding media may remove material from blade 74 at different rates, with different rates of wear and different resultant finishes to both cutting edge 76 of knife 70 and to an optical surface of blade 74. Different types of grinding media may also produce differences in optical quality and cutting feel at cutting edge 76 of knife 70. For example, a razor-sharp cutting edge 76 sharpened with a high grit abrasive may provide a satisfying slicing feel through paper, while a jagged cutting edge 76 sharpened using a lower abrasive grit may be more durable and better suited to softer foods. As will be discussed below, during automated sharpening of knife 70, information about the sharpness level, surface finish, and blade profile may be determined using one or more of sensors 44, 46, and/or 48, and this information may be used to select a particular type or grid of abrasive and to further select a particular grind head 18 and/or a particular pair of grind wheels 58, 60 having that abrasive. In some exemplary embodiments, the selection of a particular grind head 18 or a particular pair of grind wheels 58, 60 may be based on a user input or some other indication or information regarding usage of knife 70.

Controller 22 (see FIG. 1) may be configured to receive signals from one or more sensors (e.g. sensors 44, 46, and/or 48) and control one or more actuators (e.g. primary actuators 50, grind actuator 56, centerline adjustment actuator 80, vice actuator, etc.) during operation of machine 10. As illustrated in FIG. 1, controller 22 may include one or more processors 24 and/or one or more memory devices 26. Processor 24 may embody a single or multiple microprocessors, digital signal processors (DSPs), etc. Numerous commercially available microprocessors may be configured to perform the functions of processor 24. Various other known circuits may be associated with processor 24, including power supply circuitry, signal-conditioning circuitry, and communication circuitry.

The one or more memory devices 26 may store, for example, data and/or one or more control routines or instructions for processing the one or more signals received from one or more sensors (e.g. sensors 44, 46, and/or 48), and/or to control operations of one or more actuators (e.g. primary actuators 50, grind actuator 56, centerline adjustment actuator 80, vice actuator, etc.). Memory device 26 may embody non-transitory computer-readable media, for example, Random Access Memory (RAM) devices, NOR or NAND flash memory devices, and Read Only Memory (ROM) devices, CD-ROMs, hard disks, floppy drives, optical media, solid state storage media, etc.

Controller 22 may receive one or more input signals from touchscreen display 36 or other input devices associated with machine 10 and may execute the routines or instructions stored in the one or more memory devices 26 to generate and deliver one or more command signals to one or more components of machine 10. In some exemplary embodiments, memory device 26 may also store one or more databases that may include information (e.g. brand name, blade material name or type, dimensions, or other information) regarding a plurality of knives 70, and or information regarding knife sharpening parameters (e.g. abrasive type, grind wheel speed, grind wheel centerline distance or apex angle $\phi$, rate of advance of sensor head 16, grind head 18, or grind wheels 58, 60 along direction A, etc.). It is also contemplated that in some exemplary embodiments, the database may be external to machine 10 and controller 22 may be configured to access the external database via wired or wireless connections over a network.

Figure 4A:
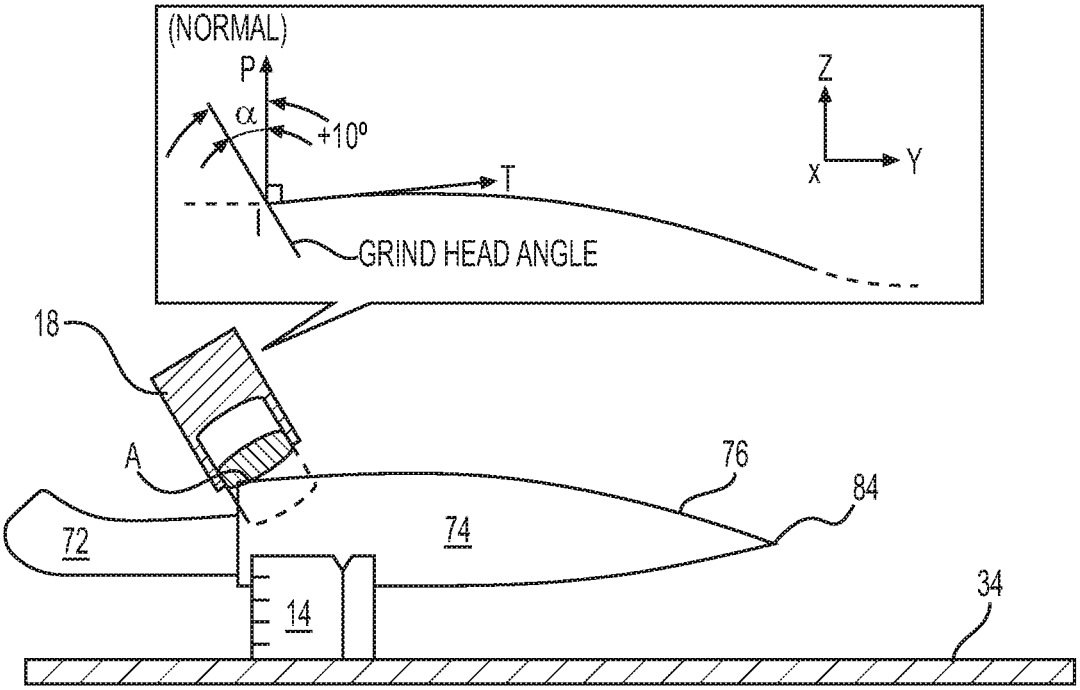
FIGS. 4A-4C illustrate positions of an exemplary grind head as it advances along a length of a knife in the automatic knife-sharpening machine of FIG. 1.
Figure 4B:
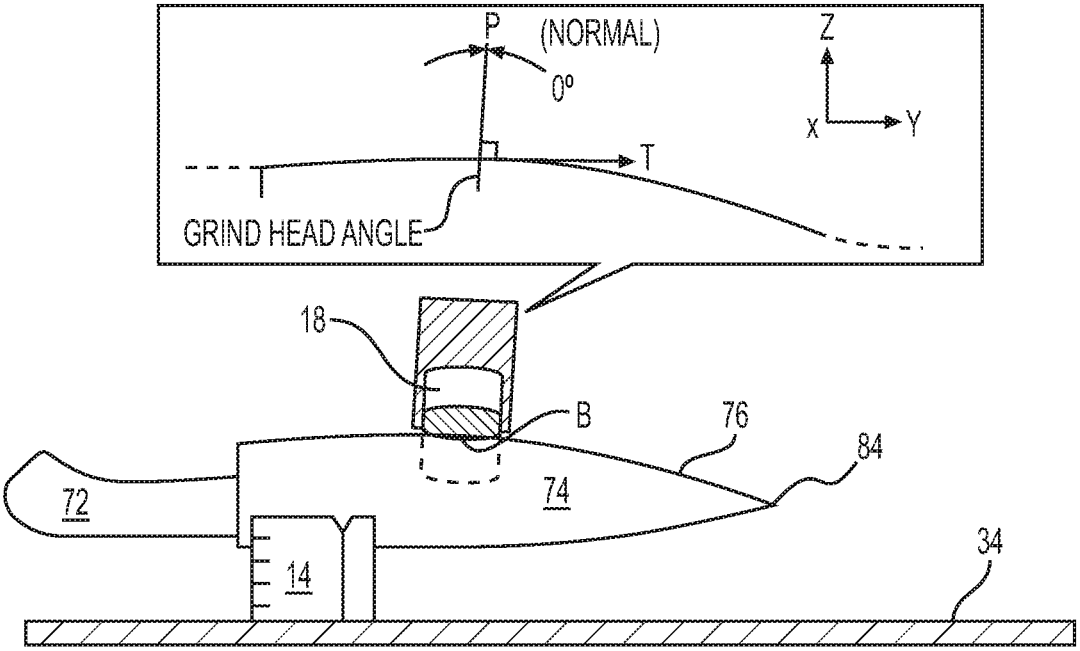
Figure 4C:
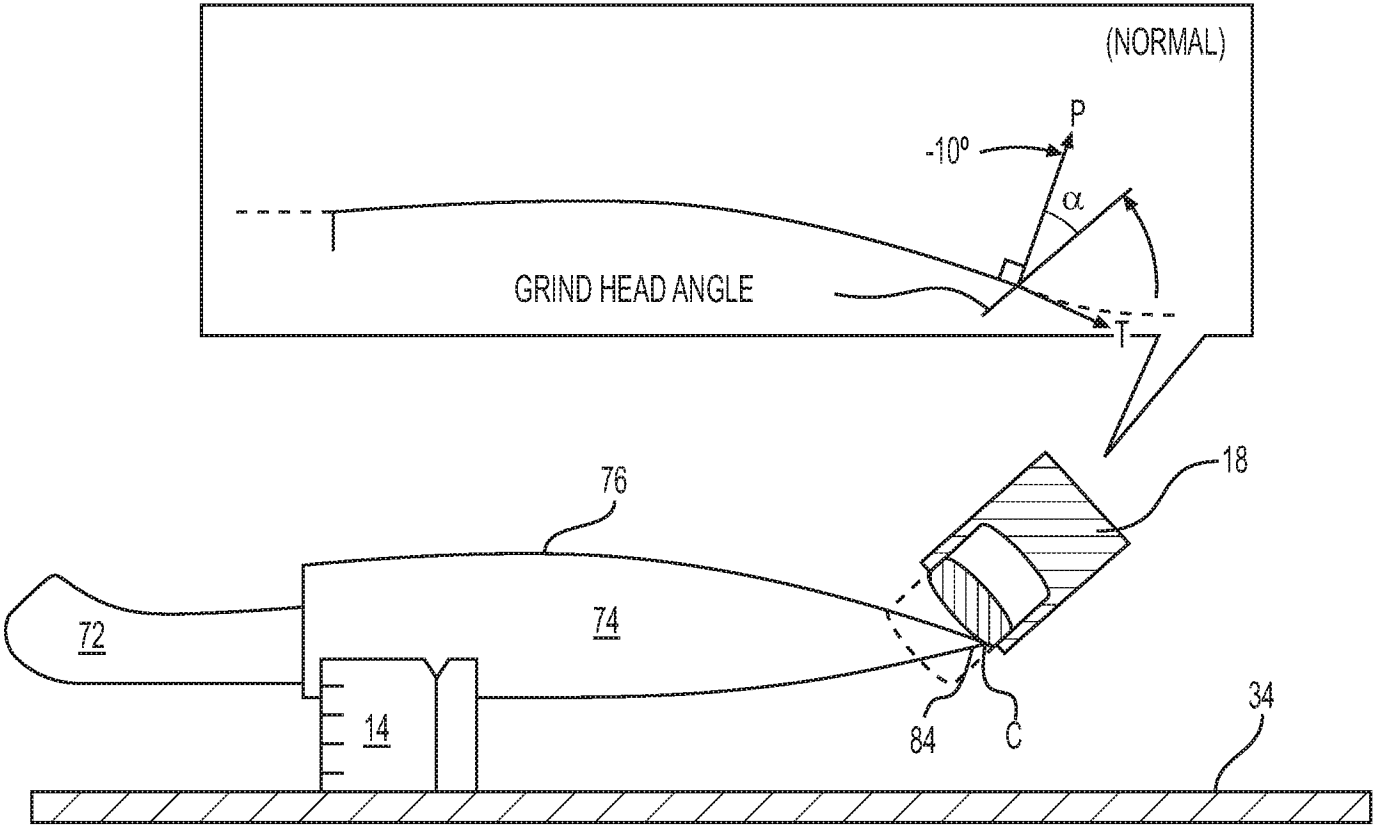

FIG. 4A-4C illustrate how grind head 18 may move along blade 74 of knife 70 during a grinding cycle. For example, as illustrated in FIG. 4A, blade 74 of knife 70 may be retained in vice 14. Controller 22 may be configured to move (or advance) grind head 18 in a longitudinal direction of blade 74 along the y-axis (e.g. parallel to A) from a position adjacent vice 14 to a position adjacent tip 84 of blade 74, Controller 22 may be configured to move grind head 18 and/or vice 14 in a z direction (e.g. vertically or parallel to B) to bring grinding wheels 58, 60 into contact with cutting edge 76 of blade 74. Further still, controller 22 may be configured to pitch grind head 18 about an axis x perpendicular to the y and z axes at an angle $\alpha$ defined relative to an axis generally perpendicular to a local tangent "T" to cutting edge 76, Doing so may allow at least one axis of grind wheels 58 or 60 to be positioned parallel to local tangent T of cutting edge 76.

In one exemplary embodiment as illustrated in FIG. 4A, when initiating a grind cycle, controller 22 may control one or more primary actuators 50 to position grind head 18 at a first longitudinal position defined by a first end of cutting edge 76 adjacent vice 14. Controller 22 may also be configured to position grind head 18 at a starting pitch angle $\alpha$ to locate grind surfaces at a front end of the interdigitated grind wheels 58, 60. Doing so may cause a point A adjacent one end of the grind surface of the interdigitated grind wheels 58, 60 to be in contact with cutting edge 76, As further illustrated in FIG. 4B, while retracting grind head 18 to a second longitudinal position defined adjacent, for example, a midpoint of the blade profile, controller 22 may adjust a position of grind head such that angle $\alpha$ is about zero. Doing so may cause a point 13 adjacent a center of the grind surface of the interdigitated grind wheels 58, 60 to be in contact with cutting edge 76. As further illustrated in FIG.

4C, while retracting grind head 18 to a third longitudinal position defined by a distal end of the blade profile (e.g., near tip 84 of the blade), controller 22 may orient grind head 18 to a pitch angle α such that grind surface is parallel to a local tangent at the tip of cutting edge 76. By doing so, controller 22 may cause a point C adjacent an opposite end of the grind surface to be in contact with cutting edge 76. It will be understood from FIGS. 4A-4C, that as grind head 18 is moved from a position adjacent vice 14 to a position adjacent a tip of blade 74, the entirety of the grind surface formed by the interdigitated grind wheels 58, 60 may be used to grind cutting edge 76. Pitching grind head 18 in this manner may help ensure grind wheels 58, 60 are subject to uniform wear.

As illustrated in FIG. 1, scanner or blade sensor 44 may be mounted on sensor head 16. Blade sensor 44 may include a line scan camera that may include a single column of pixels and may be configured to output one-pixel-wide, many-pixel-tall images of a side of blade 74 mounted in vice 14. As sensor head 16 is moved (advanced) along direction A (or parallel to the y-axis), blade sensor 44 may capture a plurality of one-pixel-wide images. In one exemplary embodiment, the line scan camera may be arranged with the column of pixels parallel to a vertical axis (e.g., z-axis perpendicular to the rotational axes of the grind wheels 58, 60), and with a vertical center of the field of view of the line scan camera. As sensor head 16 is advanced along the y-axis, controller 22 may be configured to shift blade sensor 44 vertically relative to vice 14 to help maintain a detected cutting edge 76 within a vertical center of the field of view of the line scan camera. Sensor head 16 and/or blade sensor 44 may include a position sensor, for example, in the form of a linear or rotary optical encoder that may be configured to output signals representing changes in absolute or relative position of blade sensor 44. Controller 22 may cause sensor head 16 to translate in steps (e.g. 50 micron) and obtain a series of line scan images using blade sensor 44. Controller 22 may pair the line scan images with the absolute/relative positions of blade sensor 44 to generate a composite 2D image of blade 74. Controller 22 may implement thresholding, computer vision, and/or other techniques to identify pixels in this composite 2D image that represent cutting edge 76 of blade 74 and extract a blade profile (e.g. shape of cutting edge 76). As also discussed above, in some exemplary embodiments, blade sensor 44 may instead be positioned in grind head 18 and instead of moving sensor head 16, controller 22 may cause grind head 18 to move along both the y and z-axis directions to generate the plurality of line scan images.

An exemplary embodiment of machine 10 with scanner 44 implemented in grind head 18 is discussed in detail in U.S. patent application Ser. No. 16/138,905, filed Sep. 21, 2018, the contents of which are incorporated herein in their entirety.

Machine 10 may also include sharpness sensor 46, which may be implemented on sensor head 16 or in grind head 18. Sharpness sensor 46 may be configured to determine a level of sharpness of cutting edge 76 of blade 74. The level of sharpness may be quantified in many ways. For example, in one exemplary embodiment, the level of sharpness may be quantified in terms of a percentage with a 100% level signifying a sharp knife and a 0% level signifying a dull knife. In other exemplary embodiments, the level of sharpness may be defined on a scale from 1 to 5, or 1 to 20, etc. with a lower value signifying a dull knife and a higher value signifying a sharp knife. In yet other embodiments, the level of sharpness may be qualitative (e.g. low, medium, high).

Figure 5B:
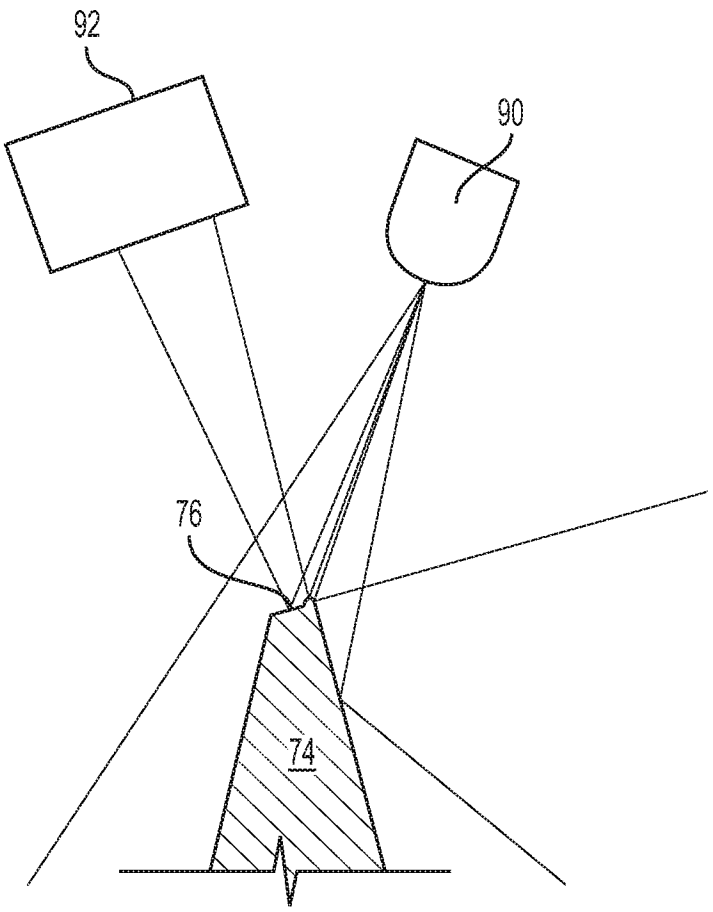
FIGS. 5A and 5B illustrate an exemplary embodiment of a sharpness sensor for the automatic knife sharpening machine of FIG. 1.
Figure 5A:
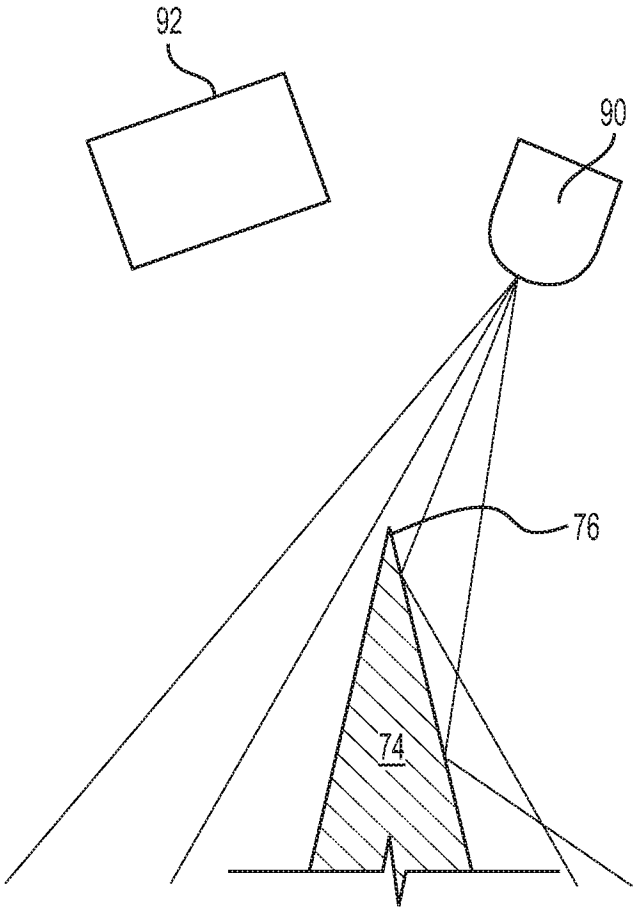

Sharpness Detection by Reflection of Impinging Light: FIGS. 5A and 5B illustrate an exemplary embodiment of sharpness sensor 46 that may include light source 90 and receiver 92. In one exemplary embodiment as illustrated in FIG. 5A, light source 90 may take the form of a light emitting diode (LED) and receiver 92 may include a camera, although other types alight sources 90 and receivers 92 (e.g. light sensors) are also contemplated. As illustrated in FIG. 5A, light source 90 and receiver 92 may be positioned on opposite sides of blade 74 of knife 70. Light source 90 may be configured to direct light towards cutting edge 76 of blade 74. Light source may be configured to generate light of a single wavelength or plurality of wavelengths. For example, light source may generate infra-red light, visible light, ultra-violet light, etc. It is also contemplated that in some exemplary embodiments light source 90 may instead include a source of electromagnetic radiation capable of generating for example, x-rays, microwaves, ultrasonic waves, or other types of electromagnetic radiation which may be reflected by cutting edge 76. Likewise, light receiver 92 may include a sensor capable of detecting the light and/or electromagnetic radiation reflected by cutting edge 76.

As illustrated in FIG. 5A, when cutting edge 76 is relatively sharp, little or no light or electromagnetic radiation from light source 90 may be reflected by cutting edge 76 towards light receiver 92. Thus, for example, at a relatively high sharpness level of cutting edge 76, receiver 92 may receive little or no light or electromagnetic radiation from cutting edge 76. FIG. 5B illustrates an exemplary blade 74 that is relatively dull compared to blade 74 of FIG. 5A. As illustrated in FIG. 5B, because of the lower sharpness level of cutting edge 76, light and/or electromagnetic radiation may be reflected by cutting edge 76 and receiver 92 may detect more light or electromagnetic radiation reflected by cutting edge 76 as compared to receiver 92 of FIG. 5A. Controller 22 may receive signals from light receiver 92 and may determine a sharpness level of cutting edge 76 based on the receive signals. For example, controller 22 may determine one or more of parameters such as an amplitude, an intensity, an amount of energy, or another parameter characteristic of light reflected by cutting edge 76 and detected by light receiver 92. Controller 22 may determine a level of sharpness of cutting edge 76 based on the determined parameters.

By way of example, controller 22 may assign a value of 100% when a determined intensity of light corresponds to a condition in which all the light emitted by light source 90 is received by light receiver 92. Similarly, for example, controller 22 may assign a value of 0% when a determined intensity of light corresponds to a condition when no light from light source 90 is received by light receiver 92. Controller 22 may assign values between 0% and 100% based on the determined intensity alight reflected by cutting edge 76 and received by light receiver 92. In one exemplary embodiment, controller 22 may define a plurality of sharpness levels, for example, very sharp (intensity between 0% and 10%), moderately sharp (intensity between 10% and 50%) and dull (intensity above 50%). It is to be understood that any number of sharpness levels may be defined by controller 22. Furthermore, it is contemplated that controller 22 may additionally or alternatively determine a sharpness level based on other parameters of reflected light, such as, amplitude, amount of energy, etc.

Sharpness Detection by Laser Diffraction: in some exemplary embodiments, light source 90 may be configured to direct a laser light having a known wavelength on cutting edge 76. For example, light source 90 may be located on one side of blade 74 such that light source 90 may direct laser light on cutting edge 76 generally perpendicular to the one side of blade 74. Receiver 92 may be positioned on an opposite side of blade 74 (relative to light source 90). Receiver 92 may be configured to capture an image of a diffraction pattern generated by cutting edge 76. Controller 22 may be configured to analyze the captured image and determine various parameters associated with the diffraction pattern. For example, controller 22 may determine widths of the bands in the diffraction pattern. In other exemplary embodiments, controller 22 may determine an intensity profile (e.g. intensity variation across the bands of the diffraction pattern). Controller 22 may be configured to determine a sharpness level of cutting edge 76 based on the determined parameters associated with the diffraction pattern. By way of example, when controller 22 detects changes of intensity in the diffraction pattern above a predetermined threshold, controller 22 may determine that cutting edge 76 has a high sharpness level. Conversely, when controller 22 detects that the changes of intensity in the diffraction pattern are below the predetermined threshold, controller 22 may determine that a sharpness level of cutting edge 76 is low. It is contemplated that controller 22 may be configured to determine a plurality of sharpness levels of cutting edge 76 based on a plurality of thresholds associated with intensity variations in the diffraction pattern.

Sharpness Detection by Camera Inspection: In some exemplary embodiments, receiver 92 of sharpness sensor 46 may include a camera configured to capture an image of blade 74. Controller 22 may be configured to compare the captured image of blade 74 with a known good image of a sharp knife 70 to determine a sharpness level of cutting edge 76. For example, controller 22 may implement thresholding, computer vision, and/or other techniques to identify pixels in the captured image of blade 74 that represent cutting edge 76 of blade 74. Controller 22 may compare the identified pixels with corresponding pixels of the known good image to determine the sharpness level. By way of example, controller may determine the sharpness levels of cutting edge 76 by comparing a deviation between the positions of pixels in the captured and known good images with one or more predetermined threshold deviations. For example, when a maximum deviation between the positions of pixels in the captured and known good images is less than a predetermined deviation threshold, controller 22 may determine that cutting edge 76 has a high sharpness level. Conversely, when a maximum deviation between the positions of pixels in the captured and known good images is more than a predetermined deviation threshold, controller 22 may determine that cutting edge 76 has a low sharpness level.

Sharpness Detection by Microscope Inspection: In some exemplary embodiments, the camera in sharpness sensor 46 may be capable of performing microscopic inspection of blade 74. For example, the camera may be configured to obtain a plurality of images of blade 74 and cutting edge 76 at different focal lengths. Controller 22 may be configured to apply known imaging techniques to the images captured by the camera to generate a three-dimensional image of blade 74. Controller 22 may be further configured to compare the generated three-dimensional image with a 3D image of a known sharp knife. Controller may determine the level of sharpness of knife 70 by comparing one or more parameters (e.g. deviations in pixel positions) derived from the 3D image obtained by the camera and the 3D image of a known sharp knife in a manner similar to that discussed above.

Figure 6:
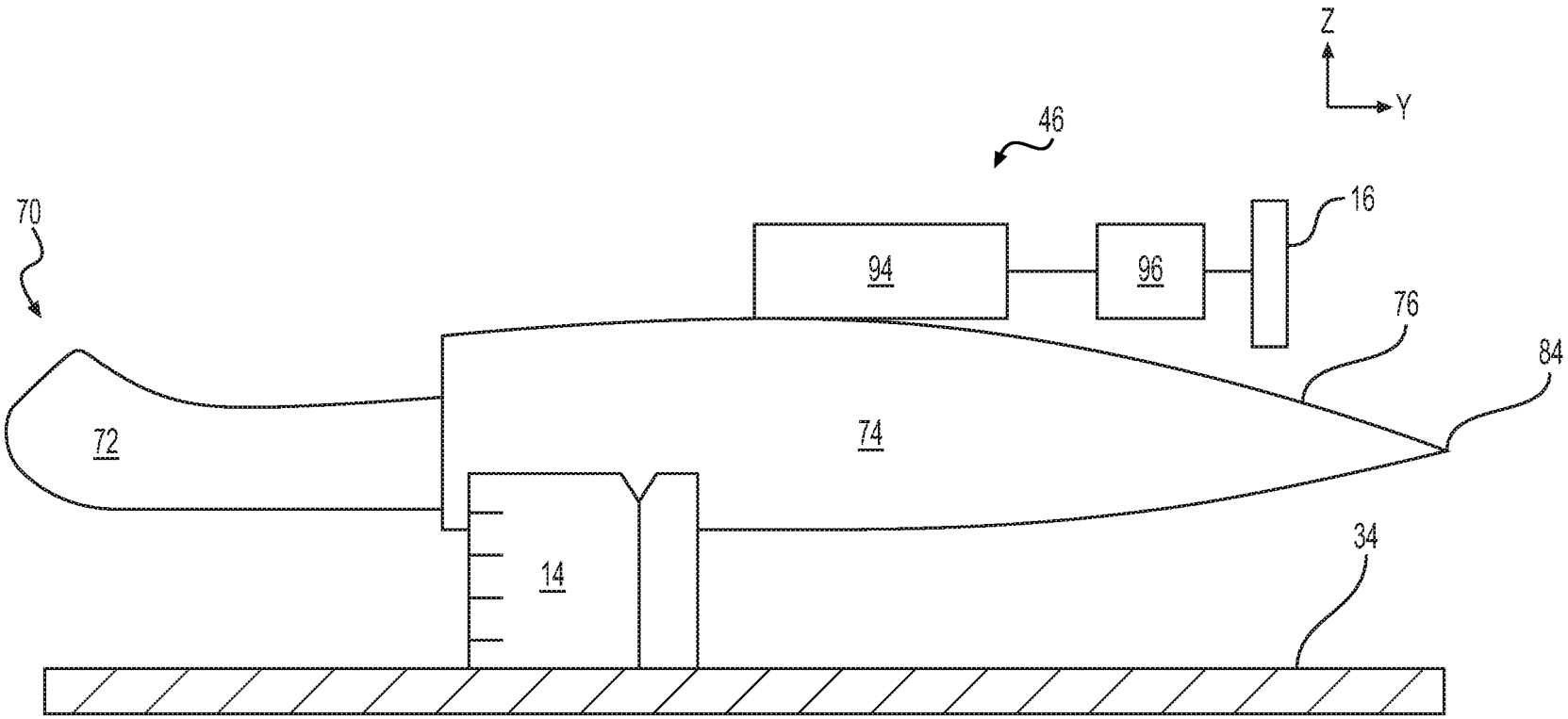
FIGS. 6 and 7 illustrate other exemplary embodiments of sharpness sensors for the automatic knife sharpening machine of FIG. 1.

Sharpness Detection by Contact Testing: FIG. 6 illustrates another exemplary embodiment of sharpness sensor 46 that may include test block 94 and sensor 96. As illustrated in FIG. 6, knife 70 may be gripped by vice 14. Test block 94 may be attached to sensor 96, which in turn may be attached to sensor head 16 of chassis 12. Sharpness sensor 46, including test block 94 and sensor 96. One or more actuators 50 may be configured to move test block 94 in both y and z-axis directions relative to blade 74 of knife 70. In the exemplary configuration illustrated in FIG. 6, controller 22 may be configured to activate one or more actuators 50 to move test block 94 towards cutting edge 76 such that test block 94 may contact cutting edge 76 of blade 74. Further, controller 22 may be configured to activate one or more actuators 50 to cause test block 94 to move in a y-axis direction while test block 94 remains in contact with cutting edge 76. Test block 94 may include a block of soft material configured to allow cutting edge 76 to penetrate a surface of test block 94. For example, when cutting edge 76 is relatively sharp, cutting edge may penetrate test block 94, which may then grip the sides of blade 74, making it difficult to move test block 94 relative to cutting edge 76. Sensor 96 may be configured to determine an amount of displacement of test block 94 over a predetermined period time in response to a predetermined amount of force applied on test block 94 while test block 94 is in contact with cutting edge 76. Additionally or alternatively, sensor 96 may be configured to determine an amount of force required to cause test block 94 to move in the y-axis direction relative to cutting edge 76 by a predetermined displacement. Controller 22 may be configured to determine a sharpness level of cutting edge 76 based on the measured displacement or force.

For example, when cutting edge 76 has a relatively high sharpness level, blade 74 may penetrate test substantially making it more difficult to move test block 94 while remaining in contact with cutting edge 76. Thus, sensor 96 may record a relatively small displacement for a predetermined force applied to test block 94 and/or a relatively high force corresponding to a predetermined displacement of test block 94 relative to cutting edge 76. Conversely, when cutting edge 76 has a low sharpness level, blade 74 may not penetrate test block sufficiently, allowing test block 100 to move relatively easily. Thus, sensor 96 may record a relatively large displacement for a predetermined force applied to test block 94 and/or a relatively low force corresponding to a predetermined displacement of test block 94 relative to cutting edge 76. Controller 22 may determine a sharpness level of cutting edge 76 based on the measured displacement and/or force.

Figure 7:
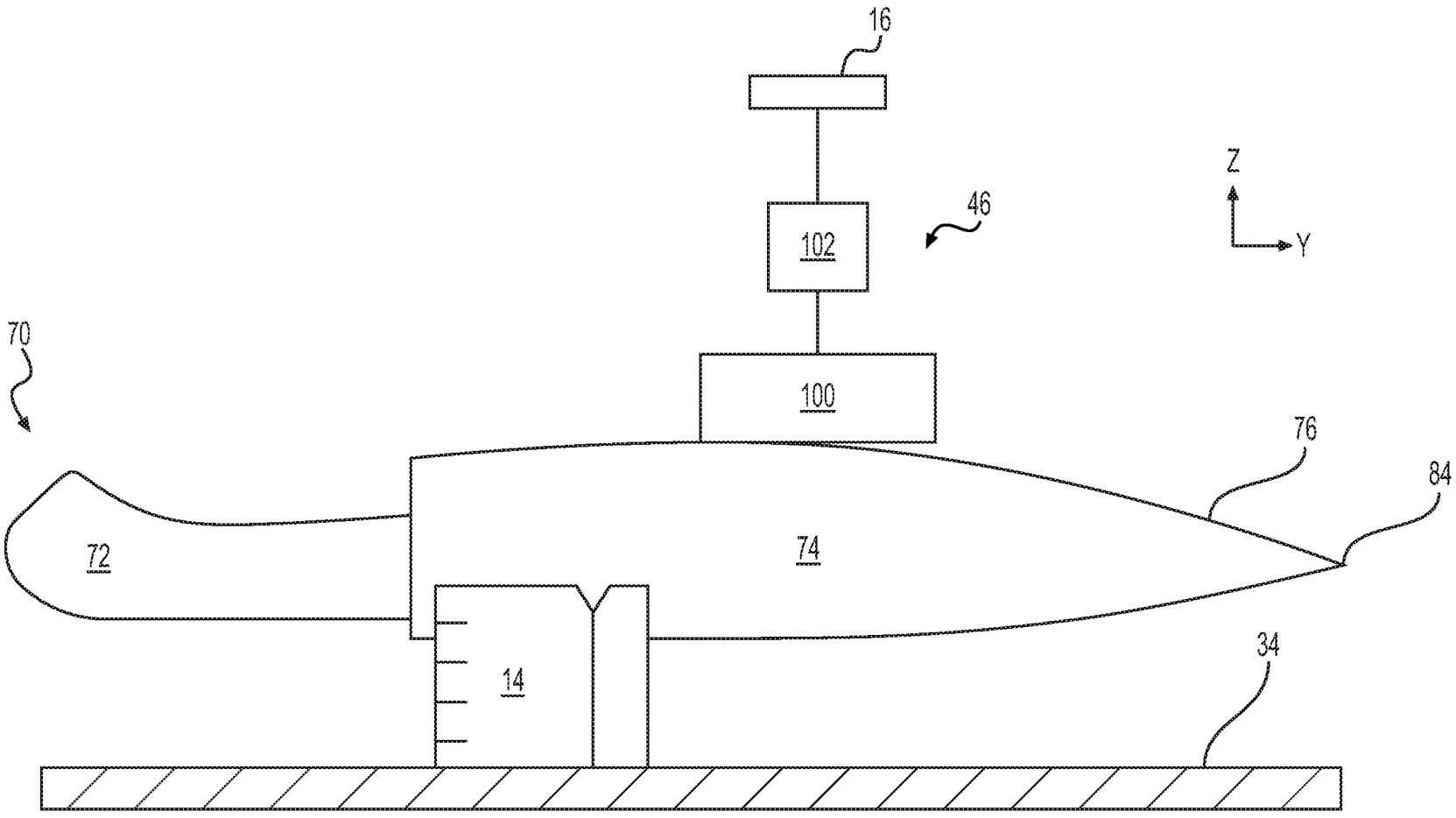

Sharpness Detection by Force Testing: FIG. 7 illustrates another exemplary embodiment of sharpness sensor 46 that may include test block 100 and sensor 102. As illustrated in FIG. 7, knife 70 may be gripped by vice 14. Test block 100 may be attached to sensor 102, which in turn may be attached to sensor head 16 of chassis 12. Sharpness sensor 46, including test block 94 and sensor 96 may be vertically movable in a z-axis direction relative to blade 74 of knife 70. Controller 22 may be configured to move activate one or more actuators 50 to move sensor head 16 and/or test block 100 so that test block 100 comes into contact with cutting edge 76. Controller 22 may continue to urge test block 100 into a downward (negative z-axis) direction so that blade 74 may penetrate test block 100. In one exemplary embodiment, controller 22 may be configured to activate the one or more actuators 50 to apply a predetermined force on test block 100. Sensor 102 may determine an amount of displacement of test block 100 in response to the predetermined force. A relatively sharp cutting edge 76 would be expected to penetrate to a greater depth (greater displacement) into test block 100 as compared to a relatively dull cutting edge 76. Controller 22 may determine a sharpness level of cutting edge 76 based on the determined amount of displacement, In another exemplary embodiment, controller 22 may be configured to cause one or more actuators 50 to apply force on test block 100 until it moves in the negative z-axis direction by a predetermined displacement. Sensor 102 may determine an amount of force required to move test block 100 by the predetermined displacement. Controller 22 may determine a sharpness level of cutting edge 76 based on the determined amount of force.

Figure 8:
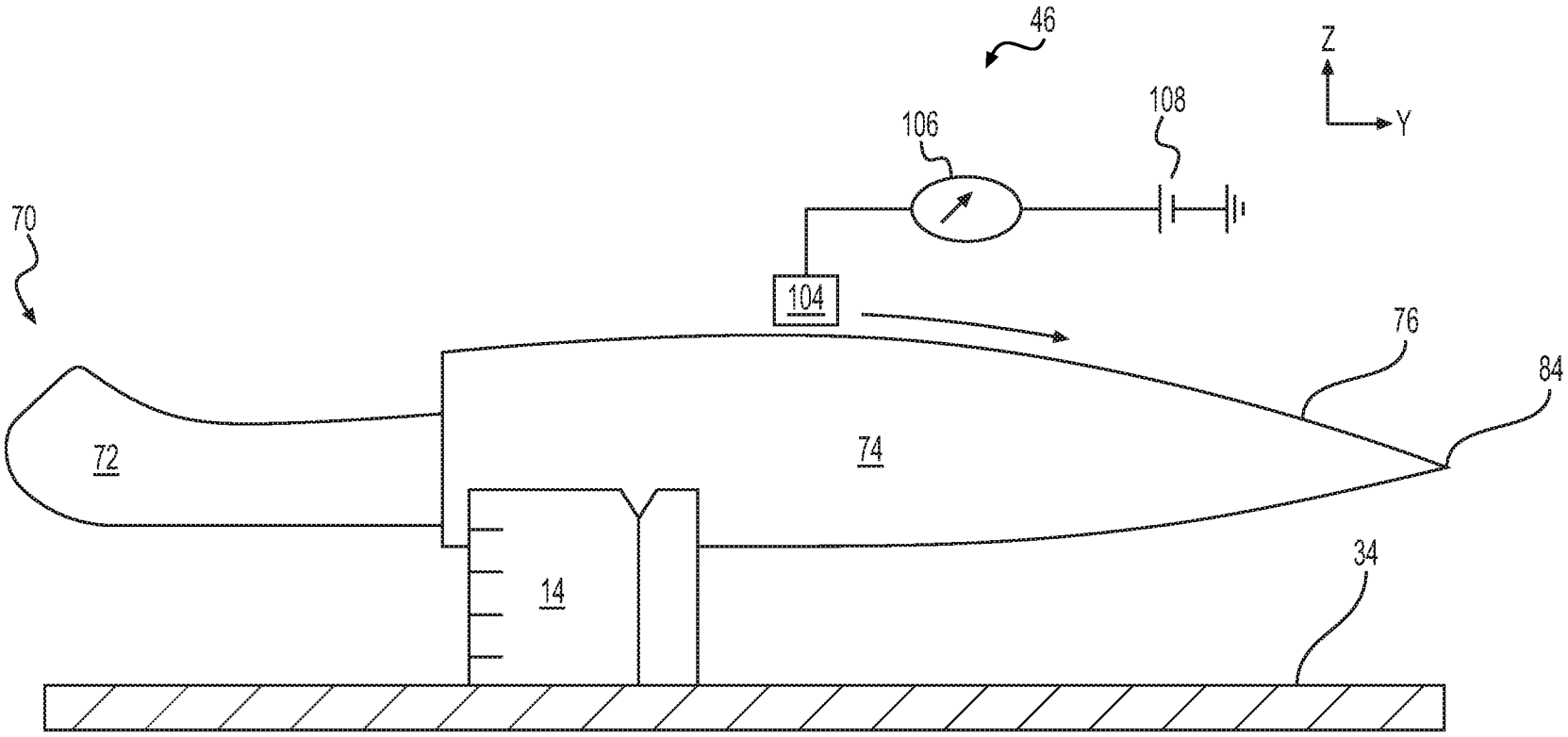
FIG. 8 illustrates an exemplary embodiment of a capacitance or inductance type sharpness sensor for the automatic knife sharpening machine of FIG. 1.

Sharpness Detection by Capacitance of Inductance Testing: FIG. 8 illustrates another exemplary embodiment of sharpness sensor 46 that may include probe 104, meter 106, and power source 108. As illustrated in FIG. 6, knife 70 may be gripped by vice 14. In one exemplary embodiment, probe 104 may be a free air capacitance probe attached, for example, to sensor head 16. A power source 108, for example, one or more batteries may supply electrical power (e.g. current and/or voltage) to probe 104. Meter 106 may, for example, include a voltmeter, an ammeter, etc. to determine a voltage drop between probe 104 and a reference voltage or to determine a current flowing through probe 104. Controller 22 may be configured determine a free air capacitance value based at least in part on the measurements made by meter 106. Controller 22 may also be configured to activate one or more actuators 50 to move sensor head 16 along the y-axis direction while maintaining a predetermined distance between probe 104 and cutting edge 76. Controller 22 may determine the free air capacitance values at different longitudinal positions along a length of blade 74. Controller 22 may also determine a level of sharpness of cutting edge 76 based on the determined capacitance values. By way of example, controller 22 may compare one or more of the determined capacitance values with threshold capacitance values to determine a level of sharpness. In some exemplary embodiments, controller 22 may determine a single capacitance value by performing one or more mathematical operations (e.g. averaging, maxima, minima, etc.) on the capacitance values determined along a length of blade 74. In some exemplary embodiments, controller 22 may determine that the sharpness level is low when the determined capacitance is below a first threshold capacitance, and that the sharpness level is high when the determined capacitance is above a second threshold capacitance. It is contemplated that controller 22 may be configured to determine a plurality of levels of sharpness based on a plurality of capacitance thresholds.

In some exemplary embodiments, probe 104 may be an inductance probe. For example, probe 104 may include an inductance coil, which may be configured to generate eddy currents in the material of blade 74. Controller 22 may be configured to determine an inductance value based at least in part on the measurements made by meter 106. Controller 22 may also be configured to activate one or more actuators 50 to move sensor head 16 along the y-axis direction while maintaining a predetermined distance between probe 104 and cutting edge 76. Controller 22 may determine the inductance values at different longitudinal positions along a length of blade 74. Controller 22 may also determine a sharpness level of cutting edge 76 based on the determined inductance values. By way of example, controller 22 may compare one or more of the determined inductance values with threshold inductance values to determine a sharpness level. In some exemplary embodiments, controller 22 may determine a single inductance value by performing one or more mathematical operations (e.g. averaging, maxima, minima, etc.) on the inductance values determined along a length of blade 74. In some exemplary embodiments, controller 22 may determine that the sharpness level is low when the determined capacitance is above a first threshold inductance, and that the sharpness level is high when the determined inductance is below a second threshold inductance. It is contemplated that controller 22 may be configured to determine a plurality of sharpness levels based on a plurality of inductance thresholds.

Figure 9B:
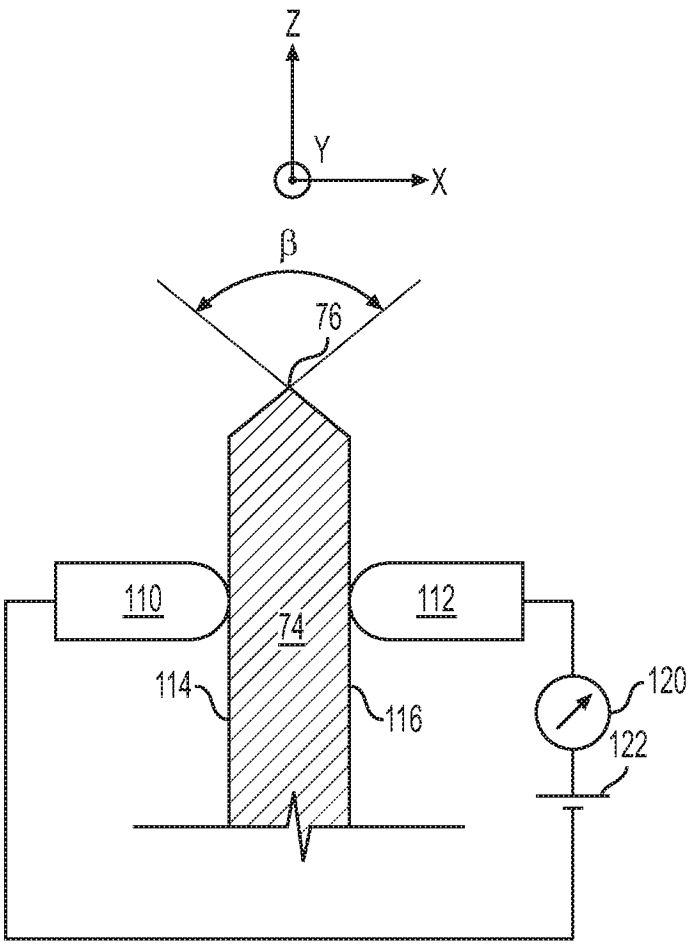
FIGS. 9A and 9B illustrate exemplary embodiments of a profile sensor for the automatic knife sharpening machine of FIG. 1.
Figure 9A:
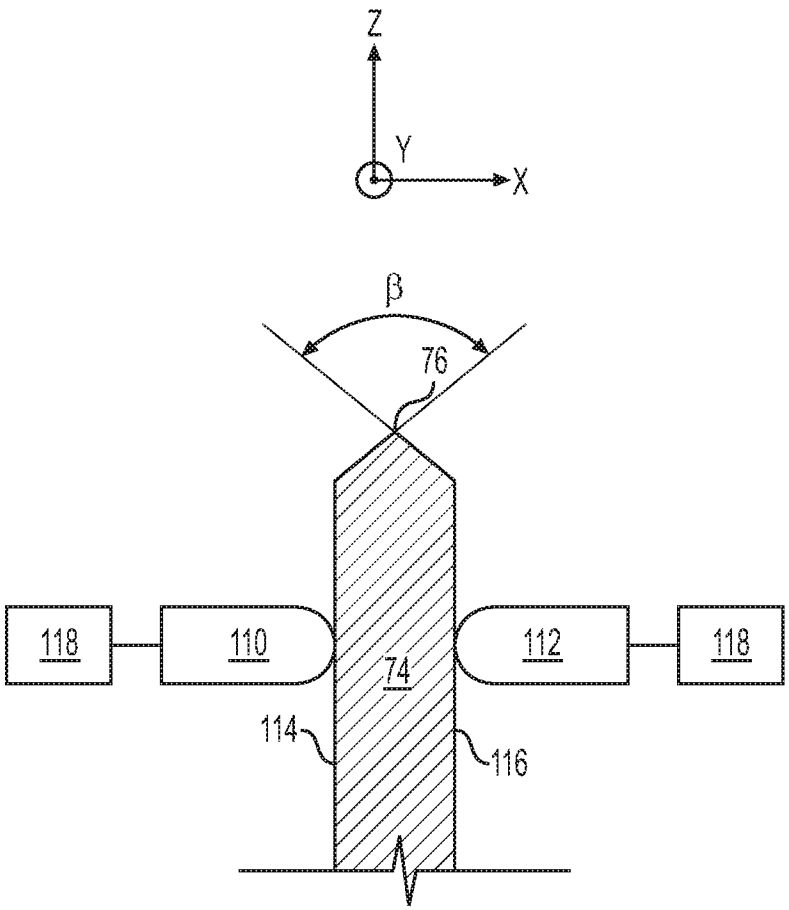

Profile Detection by Contact Testing: Machine 10 may also include profile sensor 48, which may be implemented in sensor head 16 or in grind head 18. Profile sensor 48 may be configured to determine a cross-sectional profile of blade 74 in a plane intersecting blade 74 and disposed generally perpendicular to direction A. FIG. 9A illustrates an exemplary embodiment of profile sensor 48 that may include probes 110, 112 disposed on either side of blade 74. For example, as illustrated in FIG. 9A, probe 110 may be in contact with first side 114 of blade 74 and probe 112 may be in contact with second side 116 of blade 74. Each of probes 110, 112 may be connected to displacement sensor 118. In one exemplary embodiment, controller 22 may be configured to move probes 110, 112 vertically along sides 114, 116 of blade 74 in a z-axis direction, while allowing one or both probes 110, 112 to be in contact with sides 114, 116, respectively, of blade 74. Controller 22 may be configured to determine displacements measured by displacement sensors 118 associated with probes 110, 112 at a plurality of vertical (z-axis) locations and to determine a cross-sectional profile of blade 74 based on the measured displacements. Controller 22 may also be configured to move probes 110, 112 along a length of blade 74 in a y-axis direction. At each y-axis location, controller 22 may be configured to move probes 110, 112 in the z-direction to record displacements measured by displacement sensors 118. In this manner, controller 22 may be configured to generate a plurality of cross-sectional profiles of blade 74 at positions along a length of blade 74, Controller 22 may be configured to determine thicknesses of blade 74 and bevel angles β at a plurality of locations based on the determined cross-sectional profiles. In some exemplary embodiments, controller 22 may also be configured to determine a sharpness level of cutting edge 76 based on the determined thickness of blade 74 adjacent cutting edge 76. For example, Controller 22 may compare a thickness of blade 74 adjacent cutting edge 76 with a threshold thickness and determine that cutting edge has a high sharpness level when the thickness of blade 74 adjacent cutting edge 76 is less than the threshold thickness. Conversely, controller 22 may determine that cutting edge 76 has a low sharpness level when the thickness of blade 74 adjacent cutting edge 76 is greater than the threshold thickness.

Profile Detection by Scanning Profilometer: It is contemplated that in some exemplary embodiments, one or both of probes 110, 112 may include a scanning profilometer. In this configuration, one or both of probes 110, 112 may be moved up one side (e.g. first side 114) of blade 74 over cutting edge 76 and down an opposite side (e.g. second side 116) of blade 74 to generate a cross-sectional profile of blade 74 at a particular location along a length of blade 74. One or both of probes 110, 112 may then be displaced along the length of blade 74 to a new position and the process may be repeated to generate a new cross-sectional profile at the new longitudinal position. Thus, when one or both probes 110, 112 include a scanning profilometer, controller 22 may be configured to generate cross-sectional profiles of blade 74 at a plurality of positions along a length of blade 74. Controller 22 may also be configured to determine thicknesses of blade 74 and bevel angles β based on the cross-sectional profiles. As also discussed above controller 22 may be configured to determine a level of sharpness of cutting edge 76 based on determined thicknesses of blade 74 adjacent cutting edge 76.

Profile Detection by Capacitance Testing: in one exemplary embodiment, one or both of probes 110, 112 may be capacitive touch probes. As illustrated in FIG. 9B, probes 110, 112 may form an electrical circuit that includes meter 120, and power source 122. As discussed above with respect to FIG. 8, meter 120 may be configured to measure one or more electrical parameters (e.g. voltage, current, etc.) and power source 122 may include one or more batteries. Although probes 110, 112 have been illustrated in FIG. 9B as both being part of the same electrical circuit, it is contemplated that in some exemplary embodiments each of probe 110, 112 may have its own electrical circuit each including one or more meters 120 and one or more power sources 122. Probes 110, 112 may be configured to measure a capacitance across a thickness of blade 74 by coming into contact with opposite sides 114, 116, respectively, of blade 74. Controller 22 may be configured to determine thicknesses of blade 74 and bevel angles β based on the capacitance measurements obtained from probes 110, 112, As discussed above, controller 22 may be configured to move probes 110, 112 both along the z-axis and along the y-axis to generate a thickness profile of blade 74 at a plurality of locations along a height and a length of blade 74 based on the capacitance measurements obtained using probes 110, 112. Controller 22 may also be configured to determine a thickness of blade 74 adjacent cutting edge 76 based on the determined capacitance measurements. Additionally, controller 22 may be configured to determine a sharpness level of cutting edge 76 based on a thickness of blade 74 adjacent cutting edge 76 using techniques similar to those discussed above with respect to FIG. 8. It is also contemplated that controller 22 may be configured to determine the sharpness level, using the capacitance measurements directly without first determining a thickness of blade 74 adjacent cutting edge 76.

Profile Detection by Resistance Testing: In one exemplary embodiment probes 110, 112 may be resistance probes. For example, controller 22 may cause probes 110 and 112 to be in contact with sides 114, 116, respectively of blade 74. Meter 120 may be configured to determine a voltage drop across blade 74 and a current flowing through the electrical circuit formed by probes 110, 112, meter 120, and power source 122. Controller 22 may also be configured to determine an electrical resistance across a thickness of blade 74 based on the measurements made by meter 120. As will be understood, the electrical resistance across blade 74 would be higher for higher thicknesses of blade 74. Conversely, the electrical resistance across blade 74 would be lower for lower thicknesses of blade 74. As discussed above, controller 22 may be configured to move probes 110, 112 both along the z-axis and along the y-axis to generate thicknesses of blade 74 and bevel angles β at a plurality of locations along a length of blade 74 based on the resistance measurements (e.g. by measuring voltage and current), using, for example, meter 120. Controller 22 may also be configured to determine a level of sharpness of cutting edge 76 based on a thickness of blade 74 adjacent cutting edge 76. By way of example, controller 22 may determine that cutting edge 76 has a high sharpness level, when a resistance measured using probes 110, 112 positioned adjacent cutting edge 76 is less than a predetermined resistance threshold or when a thickness of blade 74 adjacent cutting edge 76 is less than a thickness threshold. Conversely, for example, controller 22 may determine that cutting edge 76 has a low sharpness level, when a resistance measured using probes 110, 112 positioned adjacent cutting edge 76 is more than the predetermined resistance or when a thickness of blade 74 adjacent cutting edge 76 is more than a thickness threshold.

Profile Detection by Inductance Testing: In one exemplary embodiment, probes 110, 112 may be inductance probes. For example, each of probes 110, 112 may include an inductance coil, which may be positioned adjacent to but separated (or spaced apart) from sides 114, 116, respectively, by predetermined distances. Applying a biasing voltage across probes 110, 112 may cause eddy currents to be generated within the material of blade 74. Meter 120 may determine a voltage drop between probes 110, 112 and controller 22 may be configured to determine an inductance value and/or a thickness of blade 74 based on the determined voltage drop. As discussed above, controller 22 may be configured to move probes 110, 112 both along the z-axis and along the y-axis to generate thicknesses of blade 74 and bevel angles β based on the inductance measurements (e.g. by measuring voltage drops) obtained using probes 110, 112. Controller 22 may also be configured to determine a level of sharpness of cutting edge 76 based on a thickness of blade 74 adjacent cutting edge 76 using techniques similar to those discussed above with respect to FIG. 8.

Profile Detection by Radiation Backscatter: In one exemplary embodiment, profile sensor 48 may include a radiation backscatter sensor. For example, one or more profile sensors 48 may be positioned on one or both sides 114, 116 of blade 74 and may be configured to direct electromagnetic radiation towards blade 74. Profile sensors 48 may also include receivers (e.g. time-of-flight sensors) configured to detect electromagnetic radiation reflected from sides 114, 116 of blade 74. Profile sensors 48 may be configured to determine coordinate positions of one or more locations on sides 114, 116 of blade 74 based on the delay in receiving reflected radiation from sides 114, 116. Controller 22 may be further configured to determine thicknesses of blade 74 and bevel angles β based on the determined coordinate positions. Controller 22 may further be configured to determine a sharpness level of cutting edge 76 based on a thickness of blade 74 adjacent cutting edge 76 using techniques similar to those discussed above with respect to FIG. 8.

Profile Detection by Parallax Laser: In one exemplary embodiment, profile sensor 48 may include a parallax laser sensor. For example, profile sensor 48 may include light source 90 configured to direct a laser light onto side 114 or 116 of blade 74. Controller 22 may be configured to determine coordinate positions of a plurality of locations on sides 114, 116 of blade 74 based on well-known parallax and triangulation techniques. Controller 22 may also be configured to determine thicknesses and bevel angles β of blade 74 based on the determined coordinate positions. Controller 22 may be configured to determine a level of sharpness of cutting edge 76 based on a thickness of blade 74 adjacent cutting edge 76 using techniques similar to those discussed above with respect to FIG. 8.

Profile Detection by Material Impression: In one exemplary embodiment, profile sensor 48 may include test block 100 in a configuration similar to that discussed above with respect to FIG. 7, In this exemplary embodiment, controller 22 may be configured to activate one or more actuators 50 to apply a predetermined force on test block 100 to cause cutting edge 76 of blade 74 to penetrate block 100. Controller 22 may be configured to activate the one or more actuators 50 to retract test block 100 from blade 74 after a period of time. Controller 22 may then use one or more of the techniques (e.g. parallax laser, profilometer, imaging, etc.) to generate a three-dimensional model of blade 74 based on the impression created in test block 100 by blade 74. Controller 22 may also be configured to determine thicknesses of blade 74 and bevel angles β based on the 3D model of the impression created in test block 100 by blade 74. Additionally, controller 22 may be configured to determine a sharpness level of cutting edge 76 based on the determined thicknesses of blade 74.

Profile Detection by Photogrammetry: In one exemplary embodiment, one or more of scanner 44, sharpness sensor 46, and/or profile sensor 48 may include a camera. Controller 22 may be configured to move one or more of sensors 44, 46, 48 along a length of knife 70 from adjacent vice 14 to adjacent tip 84. The one or more sensors 44, 46, 48 may be configured to capture a plurality of images of knife 70 while traversing along a length of knife 70. Controller 22 may be configured to determine the co-ordinate locations of a plurality of points (e.g. generate a point cloud) on blade 74 using the captured images and photogrammetry techniques. It is also contemplated that in some exemplary embodiments, one or more of sensors 44, 46, 48 may include a structured light scanner configured to generate a three-dimensional image of blade 74. Controller 22 may be configured to determine thicknesses of blade 74 and bevel angles β based on the generated point cloud or three-dimensional image of blade 74. Additionally, controller 22 may be configured to determine a sharpness level of sharpness of cutting edge 76 of knife 70 based on the determined thicknesses.

Figure 10:
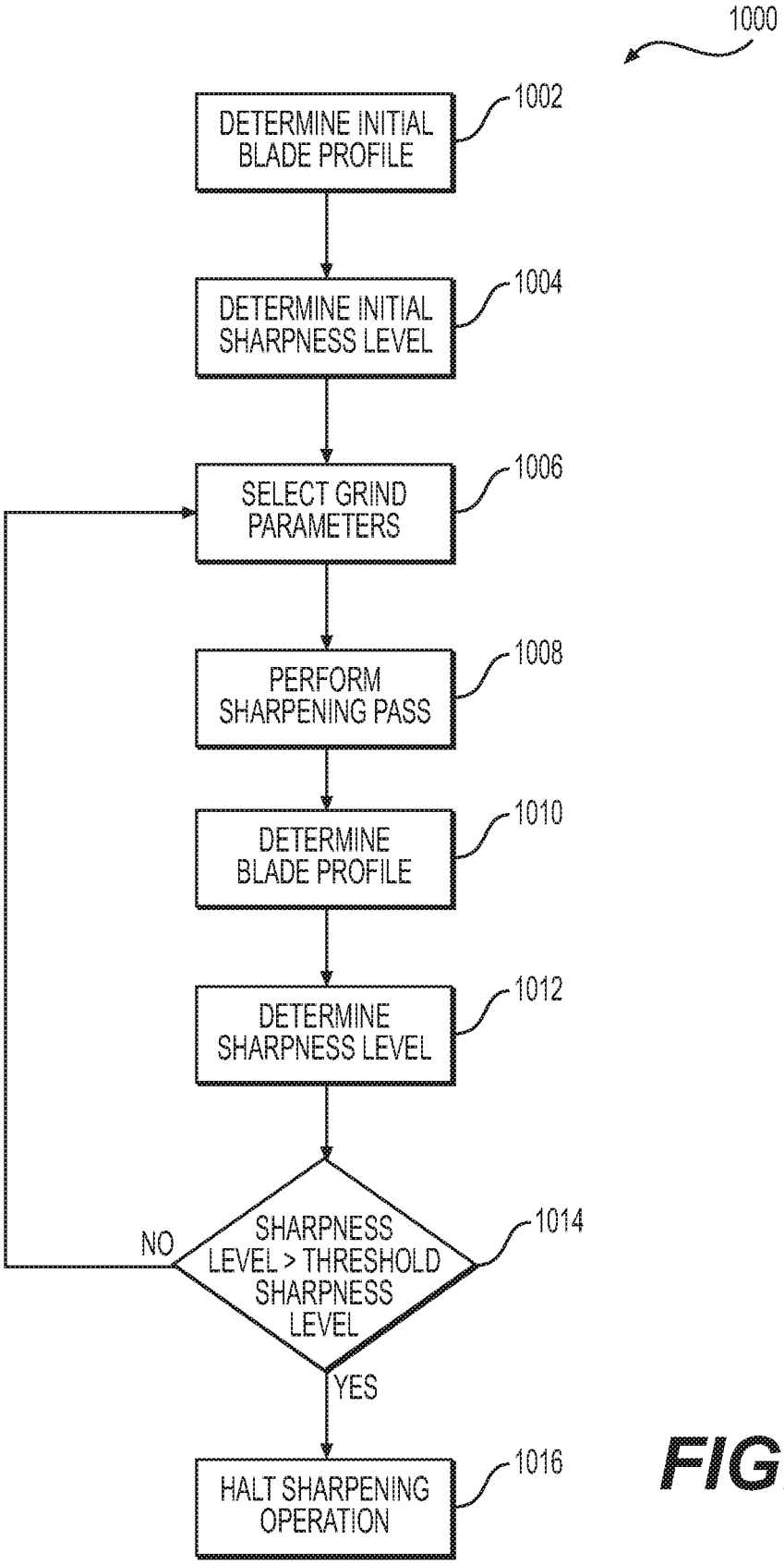
FIG. 10 illustrates an exemplary method of operation of the automatic knife sharpening machine of FIG. 1.

FIG. 10 illustrates an exemplary method 1000 of operation of machine 10. The order and arrangement of steps of method 1000 is provided for purposes of illustration. As will be appreciated from this disclosure, modifications may be made to method 1000 by, for example, by combining, removing, and/or rearranging the steps of method 1000. Some or all of the steps of method 1000 may be executed by controller 22.

In operation, a user (e.g. customer) may initiate an interaction with machine 10 by, for example, pressing a "start" button displayed on, for example, a touchscreen display 36, or by, touching the touchscreen display 36. Display 36 may send a signal to controller 22 indicating pressing of the "start button" or detection of a touch on display 36. In response, controller 22 may prompt the user via display 36 and/or via an audio system associated with machine 10 to insert a knife 70 for sharpening through knife window 42. Controller 22 may also activate one or more actuators associated with vice 14 to open vice jaws 38 and 40.

Controller 22 may activate one or more cameras associated with machine 10, which may observe vice 14, for example, by obtaining images of vice 14. The one or more cameras may send a signal to controller 22 based on a combination of recognizing motion and the placement of knives in vice 14. It is also contemplated that machine 10 may include proximity sensors, pressure sensors, break beam sensors, weight sensors, or other types of sensors that may be configured to detect the presence of knife 70 placed in vice 14. Upon receiving a signal indicating that knife 70 has been inserted in vice 14, controller 22 may activate one or more actuators to close vice jaws 38 and 40 about handle 72 and or blade 74 of knife 70, thereby gripping and retaining knife 70 in vice 14.

Method 1000 may include a step of determining an initial blade profile (Step 1002). In step 1002, controller 22 may activate one or more of scanner 44 and/or profile sensor 48. Controller 22 may position sensor head 16 adjacent vice 14 and advance sensors 44 and/or 48 along the z-axis on both sides 114, 116 of blade 74. Controller 22 may receive signals from one or more of scanner 44 and/or profile sensor 48. Controller 22 may generate a profile or shape of blade 74 based on signals received from scanner 44 and/or profile sensor 48. By way of example, controller 22 may determine coordinate positions of a plurality of locations on sides 114, 116 based on signals from one or more of scanner 44 and/or profile sensor 48. Controller 22 may move sensor head 16 from adjacent vice 14 towards tip 84 along a length of knife 70 (e.g. in the y-axis direction) by a predetermined distance and repeat the process. Controller 22 may repeatedly move sensor head 16 along a length of knife 70 (e.g. in the y-axis direction) by predetermined distances and obtain a profile or shape of blade 74 at a plurality of locations along a length of blade 74. It is contemplated that when sensors 44, 48 are mounted in grind head 18, controller 22 may move grind head 18 along a length of knife 70, without bringing grind wheels 58, 60 into contact with blade 74 to generate the profile or shape of blade 74 at a plurality of locations along a length of blade 74. Controller 22 may also use various imaging techniques, for example, thresholding, pixel detection, edge detection, computer vision, etc. to detect pixels representing cutting edge 76 of blade 74. In some exemplary embodiments, controller 22 may apply curve-fitting techniques to represent a shape of cutting edge 76 by a mathematical equation or algorithm.

Method 1000 may include a step of determining an initial sharpness level of cutting edge 76 of knife 70 (Step 1002). In step 1002, controller 22 may activate one or more sharpness sensors 46. Controller 22 may position sensor head 16 adjacent vice 14 and traverse sensors 46 along the y and/or z-axis on both sides 114, 116 of blade 74. Controller 22 may determine an initial sharpness level of cutting edge 76 using one or more of the techniques discussed above with respect to various embodiments of sensors 46, 48 in FIGS. 5-9.

Method 1000 may include step of generating grind parameters (Step 1006). In step 1006, controller 22 may determine one or more of a plurality of grind parameters for sharpening knife 70. For example, controller may determine a variation of thickness of blade 74 both along the y and z axes using the blade profile generated in, for example, step 1002. Controller 22 may also determine an initial bevel angle $\beta_{initial}$ for blade 74 based on the blade profile generated in, for example, step 1002.

Controller 22 may determine a threshold sharpness level for knife 70 based on the determined blade profile, initial bevel angle $\beta_{initial}$, and/or based on other identifying information associated with knife 70. For example, controller 22 may be configured to detect a brand of knife 70 or may receive information regarding the brand via user input using touchscreen display 36. Controller 22 may access threshold sharpness levels stored in a database to identify a desired threshold sharpness level of sharpness for the particular brand of knife 70. In some exemplary embodiments, controller 22 may determine the apex angle ϕ and a centerline distance between grind wheels 58, 60 based on, for example, the initial bevel angle $\beta_{initial}$ and the desired threshold level of sharpness for knife 70. Controller 22 may also determine a type of grinding wheel (type of grit), and a speed of rotation of grinding wheels 58, 60. In other exemplary embodiments, controller 22 may also determine a tool pathing strategy, including, for example, a rate at which grind head 18 should be advanced along a length of blade 74, pitch angles α for grind wheels 58, 60 as grind head 18 traverses along a length of blade 74, y and z coordinates for grind head 18 as grind head 18 traverses the length of blade 74, etc., based on the initial blade profile, the initial bevel angle $\beta_{initial}$ and the desired threshold level of sharpness for knife 70. Controller 22 may determine one or more of these grind parameters based on correlation tables, mathematical expressions, and/or algorithms that may be stored in memory device 26 and/or in a database associated with machine 10, Although a few grind parameters have been discussed above, it is contemplated that controller 22 may determine many other types grind parameters in step 1006.

In some exemplary embodiments, controller 22 may determine the various grind parameters based on a machine learning model. For example, training data, correlating information for a plurality of knives with grind parameters may be used to train a machine learning model. The particulars in the training data may include, for example, brand of knife, type of knife (e.g. cutting knife, paring knife, hunting knife, etc.), dimensions of knife, material of knife, hardness of knife, optimal bevel angles, apex angles, distances D, and/or or sharpness levels, type and material of abrasive (or grit) to be used for sharpening, number of sharpening passes, speed of grind wheels, rate at which grind wheels should be advanced and/or pitched, toolpath strategy, etc. Controller 22 may be configured to train the machine learning model using the training data and machine learning training schemes (e.g. decision tree). Controller 22 may then use the trained machine learning model to determine the grind parameters and/or tool pathing strategy in step 1006.

Method 1000 may include step of performing a sharpening pass on knife 70 (Step 1008). In step 1008, controller 22 may select the pair of grind wheels 58, 60 and/or grind head 18 based on the type of grind wheels (e.g. grit type) determined, for example, in step 1006. Controller 22 may adjust the centerline distance between grind wheels 58, 60 to the apex angle determined, for example, in step 1006. Controller 22 may also move grind head 18 to a position adjacent vice 14. Controller 22 may adjust a speed of grind wheels 58, 60 based on the rotational speeds determined, for example, in step 1006. Controller 22 may move grind head 18 vertically (in the z-axis direction) so that grind wheels 58 and/or 60 engage blade 74 and contact cutting edge 76 of blade 74. Controller 22 may move grind head 18 longitudinally along the A direction and vertically along direction B at rates determined for example, in step 1006, while grind wheels 58, 60 remain in contact with blade 74, until grind head 18 reaches a position beyond tip 84. Furthermore, as grind head 18 moves from adjacent vice 14 to adjacent tip 84, controller 22 may cause grind head 18 to pitch to angles α determined, for example, in step 1008. When grind head 18 is positioned adjacent tip 84, controller 22 may raise grind head 18 so that grind wheels 58, 60 come out of contact with blade 74.

Method 1000 may include step of determining a blade profile after completing a sharpening pass (Step 1010). In step 1010, controller 22 may perform functions similar to those described above in, for example, step 1002 to determine a blade profile for blade 74 of knife 70. Method 1000 may include step of determining a sharpness level of cutting edge 76 after completing a sharpening pass (Step 1012). In step 1012, controller 22 may perform functions similar to those described above in, for example, step 1004 to determine a sharpness level of cutting edge 76.

Method 1000 may include a step of determining whether the sharpness level of cutting edge 76 is greater than or equal to a threshold sharpness level (Step 1014). As discussed above, controller may determine the threshold sharpness level based on the techniques discussed above with respect to, for example, step 1006. When controller 22 determines that the sharpness level of cutting edge 76 is greater than or equal to the threshold sharpness level (Step 1014: Yes), method 1000 may proceed to step 1016 of halting sharpening operations. In step 1016, controller 22 may activate one or more actuators 50 to move grind head 18 vertically away from blade 74 so that grind wheels 58, 60 disengage from blade 74. Controller 22 may also display instructions to a user on touchscreen display 36 indicating that the sharpening process is complete. Further, controller 22 may activate one or more vice actuators to open vice jaws 38, 40 to allow the user to remove knife 70 from vice 14 via knife window 42. When controller 22 determines, however, that the sharpness level of cutting edge 76 is less than the threshold sharpness level (Step 1014: No), method 1000 may return to step 1006 of selecting grind parameters based on the new blade profile and sharpness level for blade 74 of knife 70.

By determining grind parameters in step 1006 before performing a sharpening pass on knife 70, method 1000 may allow for adjustment of the grind parameters, for example, apex angle ϕ, grinding wheel rotational speed, grinding wheel advance speed, grinding wheel type, etc., before each sharpening pass. Allowing controller 22 to select and adjust grind parameters for each sharpening pass in this manner may provide several advantages. For example, by determining the grind parameters based on a measured blade profile and level of sharpness, method 1000 may help reduce the amount of material that must be ground (or removed) from blade 74 to achieve the threshold sharpness level. Doing so may help retain more material on blade 74, thereby making blade 74 and cutting edge stronger. Furthermore, by reducing the amount of material removed from blade 74, method 1000 may also help reduce an amount of wear on grind wheels 58, 60, thereby increasing the efficiency of the grinding process.

Typically, a narrower (less thick) blade 74 adjacent cutting edge 76 produces a knife that appears sharper to the user. Likewise, a wider (thicker) blade 74 adjacent cutting edge 76 makes cutting edge 76 stronger and less prone to damage. Method 1000 may allow for adjustment of the bevel angle of blade 74 (by adjusting the apex angle of the grind wheels). For example, grinding cutting edge 76 using different apex angles during different grind cycles may allow method 1000 to produce a knife that is relatively thick adjacent cutting edge 76 while still providing a relatively high sharpness level.

A knife which has little damage may only need a touch up, while an exceedingly dull knife may need more aggressive grinding to produce a good result. Determining grind parameters based on the determined blade profile and sharpness level before performing a sharpening pass may provide other advantages. For example, when a generally sharp knife 70 experiences damage only to certain portions of cutting edge 76 or tip 84, method 1000 may allow determination of a tool pathing strategy that may grind only the affected portions or the tip to repair the knife without having to grind the entire cutting edge 76 as is typically done with conventional knife sharpening machines and methods. Other advantages may include providing a sharpened knife that may be more pleasing to a user. For example, using low grit, aggressive abrasives may leave a microscopically jagged cutting edge 76 on knife 70, which while not diminishing performance of knife 70, may be displeasing to a user. Determining grind parameters including the grit type used for the grind cycle based on the determined blade profile and sharpness level may help ensure that the sharpened cutting edge 76 does not have such jagged edges. Likewise, at a less microscopic level, the striations of a rough grind may be visible to a naked eye. Selecting finer abrasive grits in step 1006 of method 1000 may allow sharpening of knife 70 to provide a polished surface for blade 74 and cutting edge 76.

It is also well known that the grinding process generates heat in the material of blade 74 and when blade 74 is allowed to cool down after the grinding process, the material of blade 74 anneals and becomes softer, making it more prone to damage. By determining the grind parameters based on the blade profile and desired threshold sharpness level, method 1000 may help minimize the amount of material removed from blade 74, which in turn may help reduce the amount of heat generated in blade 74 during grinding, and also reduce the volume of material adjacent cutting edge 76 that is affected by the generated heat. Although FIG. 10 illustrates method 1000 in which a blade profile, sharpness level, and grind parameters are determined after every sharpening pass, it is contemplated that method 1000 may be modified so that determination of the blade profile, sharpness level, and/or grind parameters may occur after any number of sharpening passes.

It will be apparent to those skilled in the art that various modifications and variations can be made to the disclosed automatic knife sharpening machine. Other embodiments will be apparent to those skilled in the art from consideration of the specification and practice of the disclosed automatic knife sharpening machine. It is intended that the specification and examples be considered as exemplary only, with a true scope being indicated by the following claims and their equivalents.

What is claimed is:

1. An automatic knife sharpening machine, comprising:
- a vice configured to grip a blade of a knife;
- a pair of grind wheels configured to grind material from the blade;
- a scanner configured to determine a profile of an edge of the blade;
- a sharpness sensor configured to determine a sharpness level of the edge; and
- a controller configured to:
  - perform a first sharpening pass on the knife by:
    - vertically moving the grind wheels into contact with the blade at a position adjacent the vice; and
    - advancing the grind wheels longitudinally along the blade from the position adjacent the vice towards a tip of the blade with the grind wheels in contact with the blade;
  - determine, using the sharpness sensor, the sharpness level of the edge after the first sharpening pass; and
  - when the determined sharpness level is less than a threshold sharpness level, adjust a grind parameter based on the determined sharpness level and perform at least one second sharpening pass on the knife.

2. The automatic knife sharpening machine of claim 1, wherein the grind wheels are disposed in a movable grind head.

3. The automatic knife sharpening machine of claim 1, wherein the controller is further configured to pitch the grind wheels relative to the vice such that an axis of the grind wheels is within ten degrees of parallel to local tangents along the profile during the first and the second sharpening passes.

4. The automatic knife sharpening machine of claim 1, wherein the sharpness sensor includes:
- a light source configured to direct light on the edge of the blade; and
- a receiver configured to detect the light reflected by the edge.

5. The automatic knife sharpening machine of claim 4, wherein the controller is configured to determine the sharpness level of the edge based on at least one of an intensity, a power level, or a wavelength of the reflected light.

6. The automatic knife sharpening machine of claim 1, further including a profile sensor configured to determine a thickness of the blade.

7. The automatic knife sharpening machine of claim 6, wherein the controller is further configured to adjust a distance between the grind wheels based on the determined thickness.

8. The automatic knife sharpening machine of claim 1, wherein the scanner determines the profile of the edge of the blade by means of an optical sensor.

9. The automatic knife sharpening machine of claim 8, wherein the optical sensor is a camera.

10. The automatic knife sharpening machine of claim 1, further including a vacuum system fluidly coupled to the volume of air surrounding the locations where grinding occurs.

11. The automatic knife sharpening machine of claim 1, wherein the scanner and the sharpness sensor are disposed in a movable sensor head.

12. A method of automatically sharpening a knife, comprising:
- clamping a blade of the knife in a vice;
- scanning the blade using a scanner;
- determining, using a controller, an initial blade profile based on signals received from the scanner;
- performing a first sharpening pass on the knife by:
  - vertically engaging a pair of grind wheels disposed on either side of the blade with the blade at a position adjacent the vice; and
  - advancing the grind wheels along a longitudinal direction of the blade from the position adjacent the vice to adjacent a tip of the blade with the grind wheels in contact with the blade;
- determining, using a sharpness sensor, a sharpness level of an edge of the blade after performing the first sharpening pass; and
- when the determined sharpness level is less than a threshold sharpness level, adjusting a grind parameter based on the determined sharpness level, and performing at least one second sharpening pass on the knife.

13. The method of claim 12, further including:
- determining using a profile sensor a thickness of the blade; and
- adjusting a distance between the grind wheels based on the determined thickness.

14. The method of claim 13, further including:
- determining an initial sharpness level of the edge before performing the first sharpening pass;
- selecting grind parameters based on at least one of the initial sharpness level, the initial blade profile, or the thickness of the blade; and
- performing the first sharpening pass based on the selected grind parameters.

15. The method of claim 14, wherein the grind parameters include at least one of a type of abrasive of the grind wheels, a rotational speed of the grind wheels, a rate of advance of the grind wheels along the longitudinal direction of the blade, or a pitch angle of the grind wheels.

16. The method of claim 14, further including using a machine learning model to select the grind parameters.

17. The method of claim 12, wherein determining the sharpness level includes:

directing a light from a light source on the edge of the blade;

detecting, using a receiver, the light reflected by the edge; and determining the sharpness level based on at least one of an intensity, a power level, or a wavelength of the reflected light.

18. The method of claim 12, wherein the sharpness level is a first sharpness level, and the method further includes:

determining a second sharpness level of the edge after performing the at least one second sharpening pass; and halting sharpening operations when the second sharpness level is greater than the threshold sharpness level.

19. The method of claim 12, wherein the scanner and the sharpness sensor are disposed in a movable sensor head.

20. The method of claim 12, wherein the grind wheels are disposed in a movable grind head.

* * * * *